US009285719B2

(12) United States Patent
Kobayashi et al.

(10) Patent No.: US 9,285,719 B2
(45) Date of Patent: Mar. 15, 2016

(54) IMAGE FORMING APPARATUS

(71) Applicant: CANON KABUSHIKI KAISHA, Tokyo (JP)

(72) Inventors: Shinsuke Kobayashi, Yokohama (JP); Keisuke Ishizumi, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/087,227

(22) Filed: Nov. 22, 2013

(65) Prior Publication Data

US 2014/0147146 A1 May 29, 2014

(30) Foreign Application Priority Data

Nov. 29, 2012 (JP) ..... 2012-260753
Nov. 29, 2012 (JP) ..... 2012-261366

(51) Int. Cl.
*G03G 15/16* (2006.01)

(52) U.S. Cl.
CPC ..... *G03G 15/161* (2013.01); *G03G 2215/0132* (2013.01)

(58) Field of Classification Search
USPC ..... 399/66
See application file for complete search history.

(56) References Cited

U.S. PATENT DOCUMENTS 5,752,130 A * 5/1998 Tanaka et al. ..... 399/101
6,064,848 A * 5/2000 Haneda ..... 399/302
6,070,047 A * 5/2000 Ichinose et al. ..... 399/350
6,192,205 B1 * 2/2001 Motohashi ..... 399/66
8,532,531 B2 9/2013 Shimura et al.
2008/0247782 A1 * 10/2008 Sato et al. ..... 399/171
2008/0253807 A1 * 10/2008 Soda ..... 399/175
2009/0232530 A1 * 9/2009 Saito et al. ..... 399/50
2011/0150532 A1 6/2011 Shimura et al.
2011/0299866 A1 * 12/2011 Kadota et al. ..... 399/50
2012/0027453 A1 2/2012 Watanabe et al.
2012/0057888 A1 * 3/2012 Inukai ..... 399/50
2012/0106998 A1 * 5/2012 Ishizumi et al. ..... 399/50
2012/0230715 A1 * 9/2012 Ogino et al. ..... 399/66
2013/0195519 A1 8/2013 Ito et al.

FOREIGN PATENT DOCUMENTS

JP 2009-205012 A 9/2009
JP 2011-128380 A 6/2011
JP 2012-137733 A 7/2012

* cited by examiner

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

The image forming apparatus includes an image bearing member; an endless and rotatable intermediate transfer member including a primary transfer portion and a secondary transfer portion; a first current supplying member to which voltage is applied, the first current supplying member being held in contact with the intermediate transfer member to supply current in a peripheral direction of the intermediate transfer member; and a second current supplying member to which voltage is applied, the second current supplying member being held in contact with the intermediate transfer member to supply current in the peripheral direction of the intermediate transfer member. By providing one common power supply for the primary transfer and the secondary transfer power, the intermediate transfer member and the second current supplying member can be cleaned stably and efficiently.

12 Claims, 17 Drawing Sheets

IMAGE FORMING APPARATUS

BACKGROUND OF THE INVENTION

1. Field of the Invention

The present invention relates to an image forming apparatus.

2. Description of the Related Art

Related art color image forming apparatus employing an electrophotographic recording method, such as laser printers, copiers, and facsimile machines, are known to use an intermediate transfer member configuration. As a primary transfer process, a toner image formed on a photosensitive drum (image bearing member) is transferred onto an intermediate transfer belt (intermediate transfer member). By running this process at image forming stations corresponding to yellow (Y), magenta (M), cyan (C), and black (Bk), multiple color toner images are formed on a surface of the intermediate transfer belt. As a secondary transfer process, the multiple color toner images formed on the surface of the intermediate transfer belt are then transferred together onto a surface of a recording material such as paper. By then using a fixing unit to permanently fix the toner images transferred together to the surface of the recording material, a color image is formed on the recording material.

Japanese Patent Application Laid-Open No. 2012-137733 proposes a configuration that combines primary transfer and secondary transfer by making current flow from a secondary transfer portion in a peripheral direction of an intermediate transfer belt in order to reduce power supply costs in an image forming apparatus having the configuration described above.

In order to prevent transfer failure and to reduce the cost, the configuration disclosed in Japanese Patent Application Laid-Open No. 2012-137733 performs primary transfer by employing an intermediate transfer belt as an intermediate transfer member, connecting a secondary transfer voltage power supply (high voltage power supply) to a driving roller that stretches and moves the intermediate transfer belt, and causing current to flow in the peripheral direction of the intermediate transfer belt.

In contrast, Japanese Patent Application Laid-Open No. 2009-205012 proposes a method of intermediate transfer belt cleaning where, in order to clean the intermediate transfer belt following a secondary transfer process, secondary transfer toner remaining on the intermediate transfer belt is uniformly charged by a charging member contacting the intermediate transfer belt to collect the secondary transfer toner by a photosensitive drum of a primary transfer portion.

With the configuration of Japanese Patent Application Laid-Open No. 2012-137733, there is a risk that the polarity of a primary transfer portion may change in response to the polarity of current supplied from a member contacting the intermediate transfer belt. For example, if intermediate transfer belt cleaning is performed using a charging member, the polarity of the primary transfer portion may not be able to maintain a desired polarity, and it may be difficult to collect toner from the intermediate transfer belt to the photosensitive drum in the primary transfer portion.

SUMMARY OF THE INVENTION

An object of the present invention is to provide an image forming apparatus that performs primary transfer by causing current to flow in a peripheral direction of an intermediate transfer member, where toner cleaning from the intermediate transfer member can be performed stably and efficiently.

Another object of the present invention is to provide an image forming apparatus, including an image bearing member for bearing a toner image, an intermediate transfer member that is endless and rotatable, including a primary transfer portion formed by contacting the image bearing member, and a secondary transfer portion, wherein the toner image is primarily transferred from the image bearing member onto the intermediate transfer member in the primary transfer portion and secondarily transferred from the intermediate transfer member onto a transfer material in the secondary transfer portion, a first current supplying member to which a voltage is applied, the first current supplying member contacting the intermediate transfer member to supply a current in a peripheral direction of the intermediate transfer member, and a second current supplying member to which a voltage is applied, the second current supplying member contacting the intermediate transfer member to supply a current in the peripheral direction of the intermediate transfer member, wherein a resultant current of the current flowing from the first current supplying member to the intermediate transfer member and the current flowing from the second current supplying member to the intermediate transfer member is capable of forming an electric potential in the primary transfer portion, and a polarity of the electric potential formed in the primary transfer portion is determined based on the current flowing from the first current supplying member to the intermediate transfer member, regardless of the current supplied from the secondary current supplying member.

Further features of the present invention will become apparent from the following description of exemplary embodiments with reference to the attached drawings.

DESCRIPTION OF THE EMBODIMENTS

Exemplary embodiments for practicing the present invention are described below in detail with reference to the drawings. Dimensions, material properties, shapes, relative configurations, and the like for constitutive elements described in the exemplary embodiments may be suitably changed depending on configurations and various conditions of apparatus to which the present invention is applied. The scope of the present invention is not limited to the exemplary embodiments described below.

Embodiment 1

Figure 1:
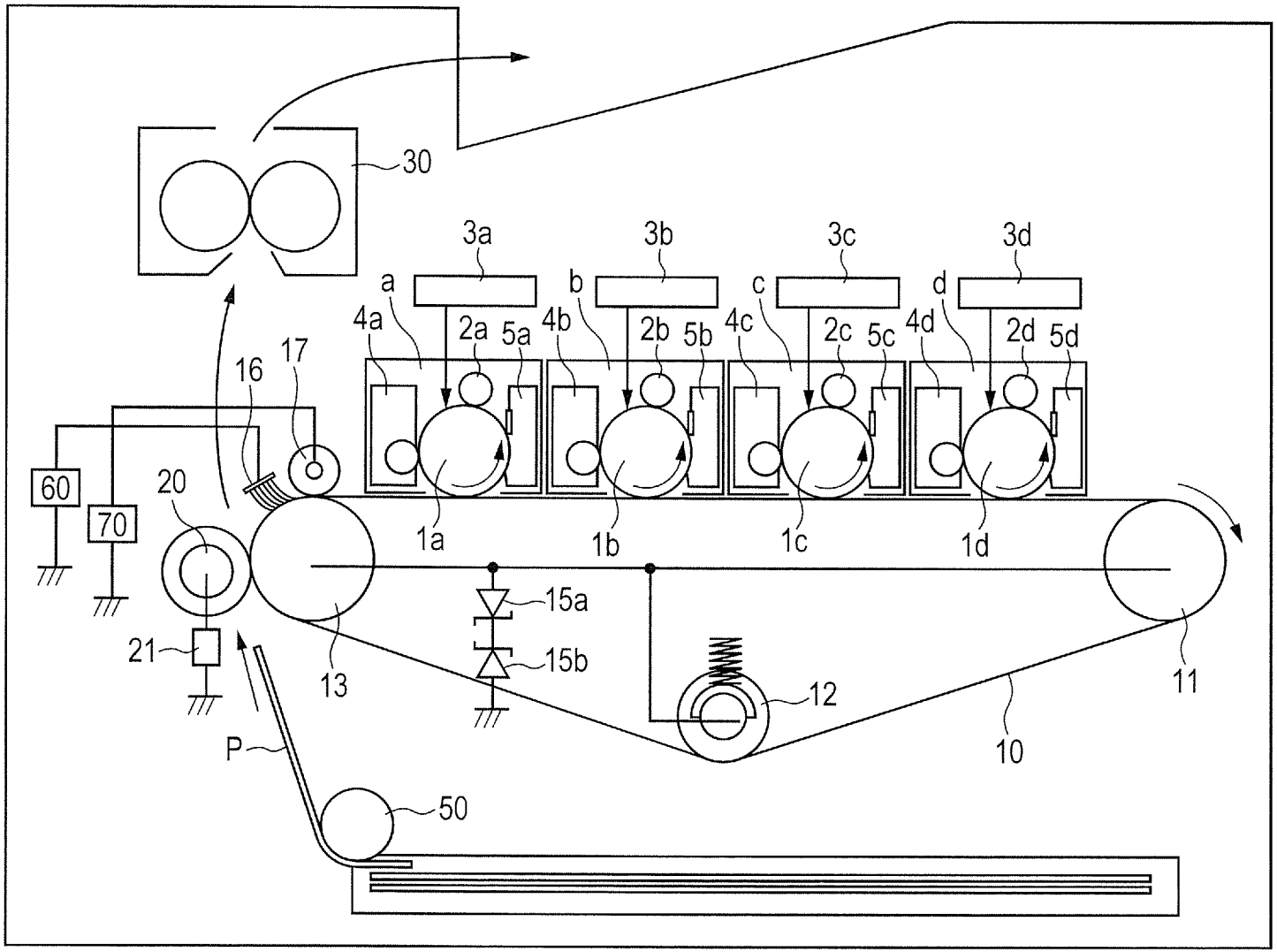
FIG. 1 is a schematic configuration diagram of an image forming apparatus according to Embodiment 1 of the present invention.

FIG. 1 is a schematic configuration diagram of a color image forming apparatus according to Embodiment 1 of the present invention. The image forming apparatus includes four image forming stations. A first station a forms a yellow toner image (developed image), a second station b forms a magenta toner image, a third station c forms a cyan toner image, and a fourth station d forms a black toner image. The image forming apparatus is a quadruple drum (inline) printer. That is, the image forming apparatus includes multiple photosensitive drums 1*a*, 1*b*, 1*c*, and 1*d*, which are first image bearing members. A full color print image is obtained by successively performing multiple transfers onto a rotatable intermediate transfer belt 10, which is a second image bearing member, while rotationally driving the photosensitive drums 1*a*, 1*b*, 1*c*, and 1*d* in the direction of respective arrows in FIG. 1.

Image Forming Operation

Each of the four image forming stations has a similar configuration, and image forming operations in the first station a is representatively described here. Descriptions of other stations are omitted.

The photosensitive drum 1*a* is uniformly charged by a charging roller 2*a* to predefined polarity and potential through a rotation process, and then receives an image exposure by an exposing unit 3*a*. An electrostatic latent image corresponding to the yellow color component image of the target color image is thus formed. The electrostatic latent image is then developed by a first developing device (yellow developing device) 4*a* in a developing position, visualizing the electrostatic latent image as a yellow toner image.

The yellow toner image formed on the photosensitive drum 1*a* is transferred (primarily transferred) onto an outer peripheral surface of the intermediate transfer belt 10 by a process of passing through a contact portion (hereinafter referred to as primary transfer portion) between the photosensitive drum 1*a* and the intermediate transfer belt 10. Primary transfer power feeding means is described below.

Primary transfer toner remaining on a surface of the photosensitive drum 1*a* is cleaned and removed by a cleaning device 5*a*, and then again supplied to image formation processes that follow charging.

A second color magenta toner image, a third color cyan toner image, and a fourth color black toner image are similarly formed on respective photosensitive drums 1*b*, 1*c*, and 1*d*, and successively transferred superimposing one another onto the intermediate transfer belt 10. A composite color image corresponding to the target color image is thus obtained.

The four color toner image on the intermediate transfer belt 10 is then passed through a contact portion, which is a secondary transfer portion, between the intermediate transfer belt 10 and a secondary transfer roller 20. A recording material P fed by a sheet feeding device 50 also passes through the secondary transfer portion at the same time. A secondary transfer voltage is applied to the secondary transfer roller 20 by a secondary transfer high voltage power supply 21, thus transferring (secondarily transferring) the color toner images on the intermediate transfer belt 10 together onto a surface of the recording material P. The recording material P bearing the four color toner image is then introduced to a fixing device 30, where applied heat and pressure melt and mix the four colors of toner, fixing the four color toner image to the recording material P. Full color print images are thus formed on the recording material P by the processes described above.

Secondary transfer toner remaining on the surface of the intermediate transfer belt 10 after secondary transfer is dispersed uniformly and charged by a conductive brush 16, which is a first charging member for remaining secondary transfer toner, upstream of the primary transfer portion. A conductive roller 17, which is a second charging member, then applies a charge to the remaining secondary transfer toner, which is transferred back to the respective photosensitive drums 1*a*, 1*b*, 1*c*, and 1*d* during the next primary transfer process. Secondary transfer toner remaining adhered on the photosensitive drums 1*a*, 1*b*, 1*c*, and 1*d* is then collected along with remaining primary transfer toner by cleaning devices 5*a*, 5*b*, 5*c*, and 5*d* corresponding to respective photosensitive drums 1*a*, 1*b*, 1*c*, and 1*d*.

Intermediate Transfer Belt (Intermediate Transfer Member)

The intermediate transfer belt 10 is made using an endless polyimide resin having a circumference of 700 mm and a thickness of 90 μm. Tension is given to the intermediate transfer belt 10 by three shafts of a driving roller 11, a tensioning roller 12, and a secondary transfer opposing roller 13. The intermediate transfer belt 10 is rotationally driven at a circumferential velocity substantially the same as that of the photosensitive drums 1*a*, 1*b*, 1*c*, and 1*d* in the direction of the arrow in FIG. 1 while being stretched at a total tension of 60 N applied by the tensioning roller 12.

The electrical characteristics of the intermediate transfer belt 10 display electrical conductivity, with a small amount of variation in resistance value depending upon ambient temperature and relative humidity level. The intermediate transfer belt 10 used in this embodiment has a volume resistivity from $1\times10^{8}$ to $1\times10^{10}$ Ω·cm, and a peripheral direction resistance value of $1\times10^{8}$Ω. The volume resistivity was measured using a Mitsubishi Chemical Corporation Hiresta-UP (MCP-HT450) with a ring probe type UR (model MCP-HTP12). The room temperature at the time of measurement was set at 23° C., the room relative humidity level was set at 50%, and measurements were made for a duration of 10 sec using an applied voltage of 500 V.

Figure 2A:
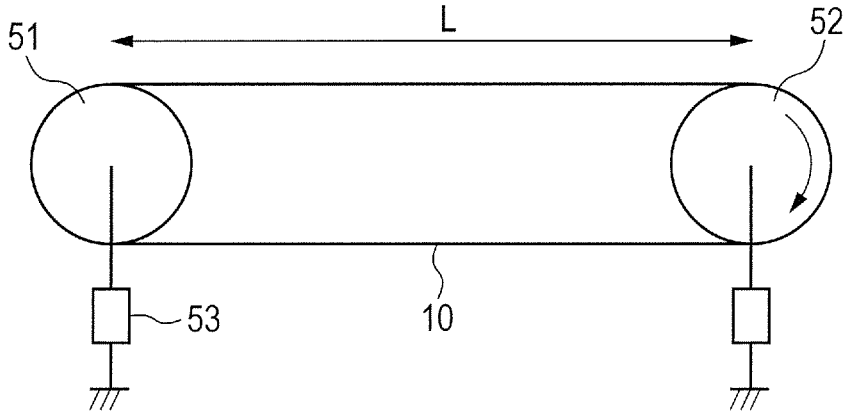
FIGS. 2A and 2B are diagrams illustrating a method of measuring resistance in a peripheral direction of an intermediate transfer belt.
Figure 2B:
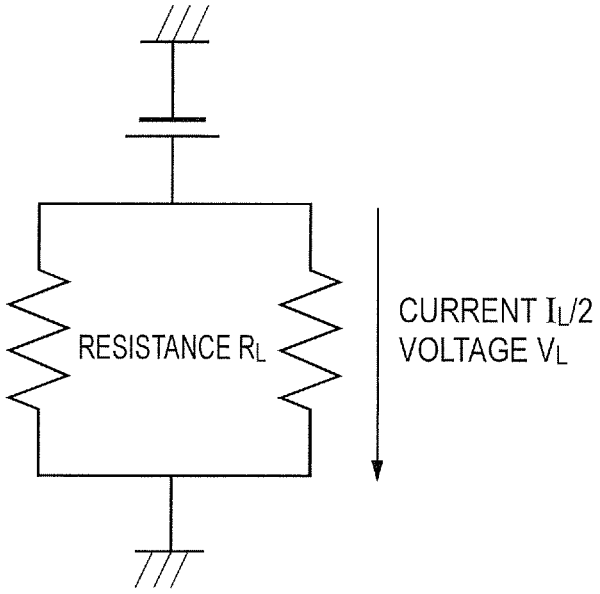

The peripheral direction resistance was measured using a peripheral direction resistance measuring jig illustrated in FIG. 2A. In FIG. 2A, the measured intermediate transfer belt 10 is tensioned by an inner surface roller 51 and a driving roller 52 to remove slack. The inner surface roller 51 made of metal is connected to a high voltage power supply 53 (manufactured by TREK, INC.), while the driving roller 52 is grounded. A surface of the driving roller 52 is covered by conductive rubber having a sufficiently low resistance with respect to the intermediate transfer belt 10. The intermediate transfer belt is rotated to reach a velocity of 100 mm/sec. With the intermediate transfer belt 10 rotating at 100 mm/sec by the driving roller 52, a constant current IL is applied to the inner surface roller 51, and a voltage VL is monitored at the high voltage power supply 53 connected to the inner surface roller 51. If a measuring system illustrated in FIG. 2A is taken as an equivalent circuit illustrated in FIG. 2B, a resistance RL in the peripheral direction of the intermediate transfer belt 10 over a distance L from the inner surface roller 51 to the driving roller 52 (300 mm in this embodiment) can be calculated by RL=2VL/IL. The peripheral direction resistance may be obtained by converting RL into resistance using the circumference of the intermediate transfer belt 10 (700 mm in this embodiment).

Note that, although a polyimide resin is used in this embodiment as the intermediate transfer belt 10 material, other thermoplastic resin materials may also be used. For example, materials such as polyester, polycarbonate, polyarylate, acrylonitrile butadiene styrene copolymer (ABS), polyphenylene sulfide (PPS), and polyvinylidene difluoride (PVDF), as well as resin blends of these materials may be used.

Secondary Transfer Roller

The secondary transfer roller 20 uses an 18 mm external diameter roller made from an 8 mm external diameter nickel plated steel rod covered by a foamed sponge that uses NBR and epichlorohydrin rubber as main components and configured to have a volume resistance of $1\times10^8$ Ω·cm and a thickness of 5 mm. Further, the secondary transfer high voltage power supply 21 is connected to the secondary transfer roller 20 so as to variably apply both positive and negative polarity voltages, and the secondary transfer roller 20 is rotated in association with rotation of the intermediate transfer belt 10 while contacting the intermediate transfer belt 10 with a pressure of 50 N. The actual resistance value in a nip portion (secondary transfer portion) with respect to the intermediate transfer belt 10 is $2\times10^7$Ω. The resistance value was measured using an Advantest Corporation R8340 ultra high resistance meter while the roller to be measured was rotated in association with a 30 mm diameter aluminum cylinder. The measurement conditions were an applied voltage of 1,000 V, an application time of 30 sec, a contact pressure of 9.8 N, and a rotational velocity of 100 mm/s for the secondary transfer roller 20. The secondary transfer nip width was approximately 3.5 mm, with a longitudinal size of 220 mm.

Conductive Brush

Figure 3A:
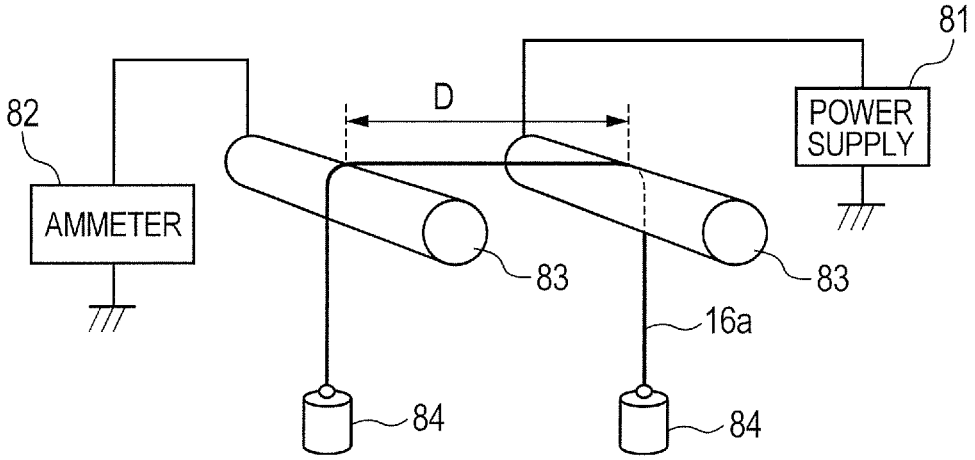
FIGS. 3A and 3B are diagrams illustrating a method of measuring resistance of a conductive brush.
Figure 3B:
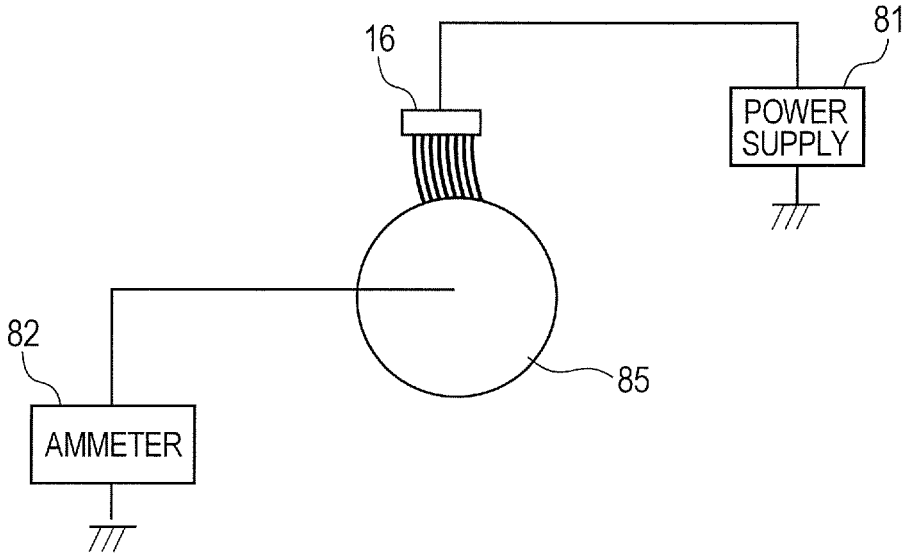

The conductive brush 16 is formed of conductive fibers. The conductive fibers use nylon as a main component with carbon used as a conductive agent. The resistance value per unit length of one conductive fiber is $1\times10^{10}$ Ω/cm, and the fineness is 300 T/60 F. A method used in measuring the resistance per unit length (Q/cm) of the conductive fibers is, as illustrated in FIG. 3A, to tension a conductive fiber 16*a* to be measured by two 5 mm diameter metal rollers 83 disposed at a distance D of 10 mm apart, and mount a 100 g weight 84 to each side to apply a load. In this state, a voltage of 200 V is applied to the conductive fiber 16*a* from a measuring power supply 81 through the metal roller 83, and the amount of current flow is read using a measuring ammeter 82, thereby calculating the resistance value (Ω·cm) of the conductive fiber 16*a* per 10 mm (1 cm). A method used in measuring resistance of the conductive brush 16 is, as illustrated in FIG. 3B, to cause the conductive brush 16 to be measured to contact to a 30 mm diameter metal roller by an intruding amount of 1.0 mm, apply a voltage of 200 V to the conductive brush 16 from the power supply 81, and read the amount of current flow using the ammeter 82, thereby calculating the resistance value. The resistance value of the conductive fiber 16*a* calculated using this method is $1\times10^8$Ω. Further, a connection is made to allow both positive and negative polarity voltages to be applied from a conductive brush high voltage power supply 60, and the conductive brush 16 is disposed to intrude by approximately 1.0 mm with respect to the intermediate transfer belt 10.

Conductive Roller

The conductive roller 17 uses an elastic roller having urethane rubber with a volume resistivity of $10^9$ Ω·cm as a main component. A connection is made to allow both positive and negative polarity voltages to be applied from a conductive roller high voltage power supply 70. The conductive roller 17 rotates in association with rotation of the intermediate transfer belt 10 while a total pressure of 9.8 N is applied against the intermediate transfer belt 10 by a spring (not shown). The actual resistance value in a nip portion (conductive roller nip portion) with respect to the intermediate transfer belt 10 is $1\times10^8$Ω. The resistance value was measured similarly to that of the secondary transfer roller, using an Advantest Corporation R8340 ultra high resistance meter while the roller to be measured was rotated in association with a 30 mm diameter aluminum cylinder. The measurement conditions were an applied voltage of 1,000 V, an application time of 30 sec, a contact pressure of 9.8 N, and a rotational velocity of 100 mm/s for the conductive roller 17. The conductive roller 17 has a nip width of approximately 1.5 mm. Note that, although urethane rubber is used as the conductive roller 17 in this embodiment, there are no limitations placed on the material used, and NBR, EPDM, epichlorohydrin, and the like may also be used.

Remaining Toner Charging Device

Figure 4:
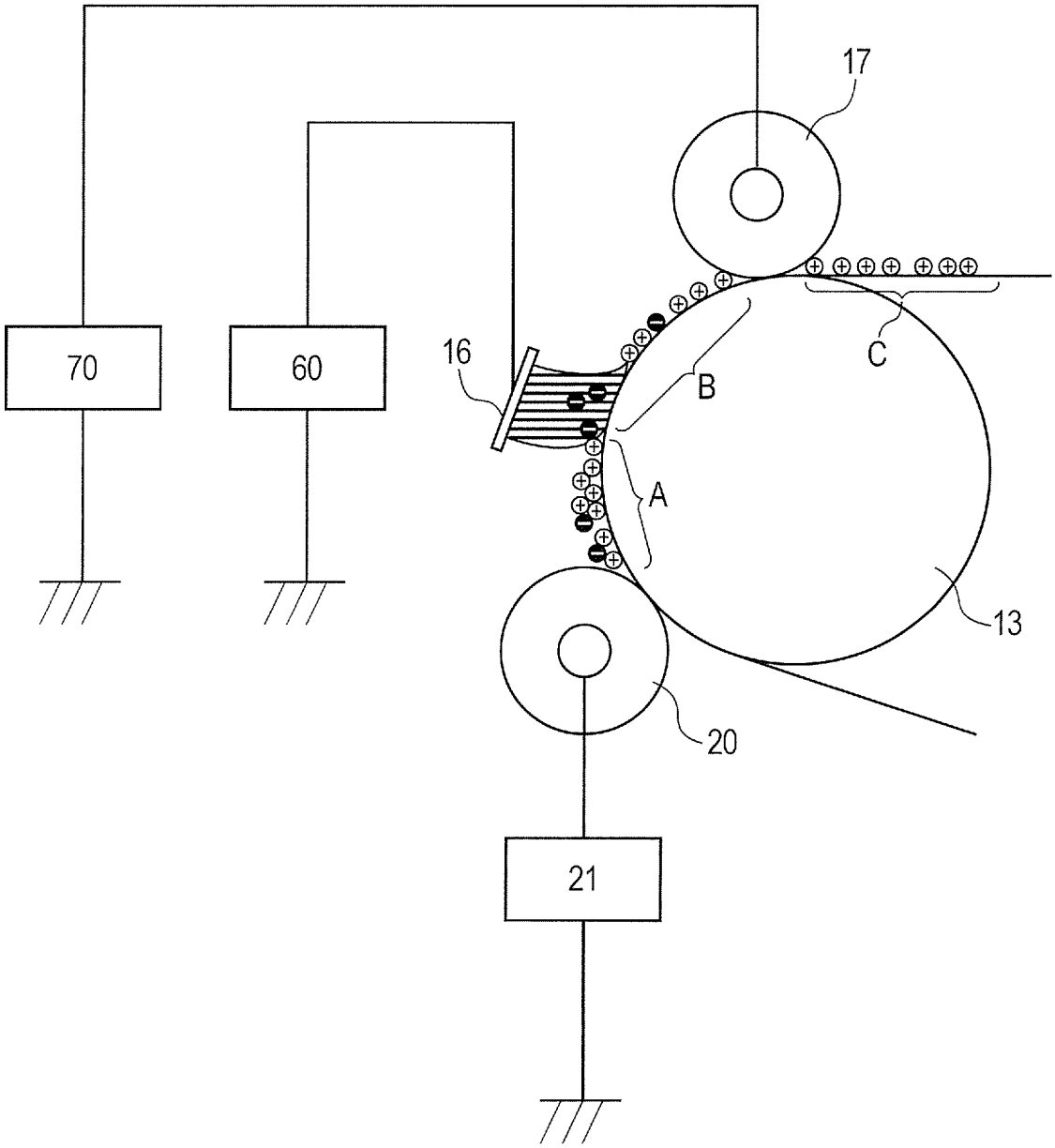
FIG. 4 is a diagram illustrating a relationship between intermediate transfer belt electric potential and primary transfer efficiency.

Toner (developing agent) used in this image forming apparatus is imparted with a negative polarity charge within developing devices 4*a*, 4*b*, 4*c*, and 4*d*. During normal image forming, the toner is secondarily transferred onto the recording material P by imparting a predefined positive polarity voltage (approximately 800 V in this embodiment) to the toner by the secondary transfer roller after the toner is primarily transferred from the photosensitive drums 1*a*, 1*b*, 1*c*, and 1*d* onto the intermediate transfer belt 10, thereby forming an image. A mixture of positive and negative polarity secondary transfer toner remains on the intermediate transfer belt 10 after secondary transfer, as illustrated in FIG. 4. FIG. 4 illustrates a relationship between the intermediate transfer belt potential and primary transfer efficiency. In addition, the secondary transfer toner is influenced by roughness in a surface of the recording material P, and remains localized on the intermediate transfer belt 10 in multiple layers (at A in FIG. 4).

In order to collect the remaining secondary transfer toner from the intermediate transfer belt 10, in this embodiment, a charging device contacting the intermediate transfer belt 10 charges the remaining secondary transfer toner, which is moved (reverse transferred) to the photosensitive drums 1*a*, 1*b*, 1*c*, and 1*d*. The charging device of this embodiment includes the conductive brush 16 and the conductive roller 17 described above.

The conductive brush 16 functions to uniformly disperse the multiple layers of remaining secondary transfer toner while charging. The remaining secondary transfer toner is dispersed mechanically due to a circumferential velocity difference with the conductive brush 16, thereby forming a substantially uniform height (at B in FIG. 4). Further, a positive polarity constant current control (at 20 μA in this embodiment) is performed on the conductive brush 16 by the conductive brush high voltage power supply 60, thereby charging the remaining secondary transfer toner to a positive polarity, the opposite of the toner polarity during developing. Negative polarity toner unable to be charged to a positive polarity is primarily collected in the conductive brush 16. Remaining secondary transfer toner that passes through the conductive brush 16 moves in a rotational direction of the intermediate transfer belt 10, and arrives at the conductive roller 17.

A desired positive polarity voltage is applied to the conductive roller 17 by the conductive roller high voltage power supply 70. Positively charged remaining secondary transfer toner that passes through the conductive brush 16 is further charged when passing by the conductive roller 17, and is imparted with an optimal positive charge for simultaneous transfer method intermediate transfer belt cleaning (at C in FIG. 4). The remaining secondary transfer toner imparted with an optimal positive charge is transferred back to the photosensitive drums 1*a*, 1*b*, 1*c*, and 1*d* in the primary transfer portion, and collected by the cleaning devices 5*a*, 5*b*, 5*c*, and 5*d* disposed in respective photosensitive drums 1*a*, 1*b*, 1*c*, and 1*d* (drum static cleaning collection). The conductive brush high voltage power supply 60 and the conductive roller high voltage power supply 70 are able to apply negative polarity voltages to the conductive brush 16 and to the conductive roller 17, respectively, not only positive polarity voltages.

Note that, the conductive roller 17 is disposed downstream of the conductive brush 16 in the rotational direction of the intermediate transfer belt 10 in this embodiment for the purpose of making the amount of charge on the toner after passing through the conductive brush 16 more uniform.

Method of Supplying Current to Primary Transfer Portion

In this image forming apparatus, the secondary transfer roller that is held in contact with the intermediate transfer belt 10 to form the secondary transfer portion is a first current supplying member that supplies current in a peripheral direction of the intermediate transfer belt 10. Further, the charging device that is held in contact with the intermediate transfer belt 10 to charge the remaining secondary transfer toner and is a second current supplying member that supplies current in the peripheral direction of the intermediate transfer belt 10.

The secondary transfer high voltage power supply 21 is used as a first power supply for applying a voltage to the first current supplying member, and the conductive brush high voltage power supply 60 and the conductive roller high voltage power supply 70 are used as a second power supply for applying a voltage to the second current supplying member. Current flowing in the peripheral direction of the intermediate transfer belt 10 charges the intermediate transfer belt 10, thereby forming potentials in each primary transfer portion. Primary transfer is performed by negative polarity toner on the photosensitive drums 1*a*, 1*b*, 1*c*, and 1*d* moving onto the intermediate transfer belt 10 due to a potential difference between the intermediate transfer belt 10 and the photosensitive drums 1*a*, 1*b*, 1*c*, and 1*d*. Current flowing from the secondary transfer roller 20, current flowing from the conductive brush 16, and current flowing from the conductive roller 17 are cumulative and form a resultant current flowing in the peripheral direction of the intermediate transfer belt 10.

Further, a constant voltage element is connected to the driving roller 11, the tensioning roller 12, and the secondary transfer opposing roller 13 that stretch the intermediate transfer belt 10. Specifically, the driving roller 11, the tensioning roller 12, and the secondary transfer opposing roller 13 are grounded through two Zener diodes 15*a* and 15*b* that are connected in series and have mutually opposite orientations. The two Zener diodes 15*a* and 15*b* each have a Zener voltage of 300 V.

A potential corresponding to the Zener diodes 15*a* and 15*b* is thus output by current flowing from the high voltage power supplies 21, 60, and 70 to the stretching rollers 11, 12, and 13 through the intermediate transfer belt 10. The Zener diodes 15*a* and 15*b* of this embodiment maintain a desired electric potential (±300 V) by current flow having a value equal to or greater than a predefined current (absolute value 5 μA), and it is possible for higher currents to be made to flow to a ground side. When the polarity of the resultant current is positive, each stretching roller maintains 300 V, and when the polarity of the resultant current is negative, each stretching roller maintains −300 V. If each stretching roller (the driving roller 11, the tensioning roller 12, and the secondary transfer opposing roller 13) maintains 300 V, then the potential of a rear surface of the intermediate transfer belt 10 similarly maintains 300 V. Further, current flowing in each stretching roller (the driving roller 11, the tensioning roller 12, and the secondary transfer opposing roller 13) is also cumulative with current flowing from the secondary transfer roller 20, current flowing from the conductive brush 16, and current flowing from the conductive roller 17. When the resultant current is positive, the potential of the rear surface of the intermediate transfer belt 10 becomes +300 V, and when the resultant current is negative, the potential of the rear surface of the intermediate transfer belt 10 becomes −300 V.

One of the Zener diodes is connected in reverse here so that even if an inverse polarity voltage is applied when performing discharge-cleaning of a charging member or the like, a stable potential can be formed in the primary transfer portion.

In an image forming apparatus where current is made to flow in the peripheral direction of the intermediate transfer belt 10, thus forming potentials in each primary transfer portion, when performing discharge-cleaning of a charging member during post-printing rotation or the like, it is possible to switch the positive and negative polarities of the rear surface potential of the intermediate transfer belt 10 in the primary transfer portion in association with switching the positive and negative polarities of the voltage output from the high voltage power supplies 60 and 70 to the charging member. When charged remaining toner T passes through a conventional collection station, the rear surface potential of the intermediate transfer belt 10 in the primary transfer portion is negative, and it therefore becomes possible for the remaining toner T to remain on the intermediate transfer belt 10. In order to clean the remaining toner T remaining on the intermediate transfer belt 10, it is necessary to additionally consider rotationally driving the intermediate transfer belt 10, and there is a concern that this may cause downtime or influence the lifetime of the image forming apparatus.

Figure 12:
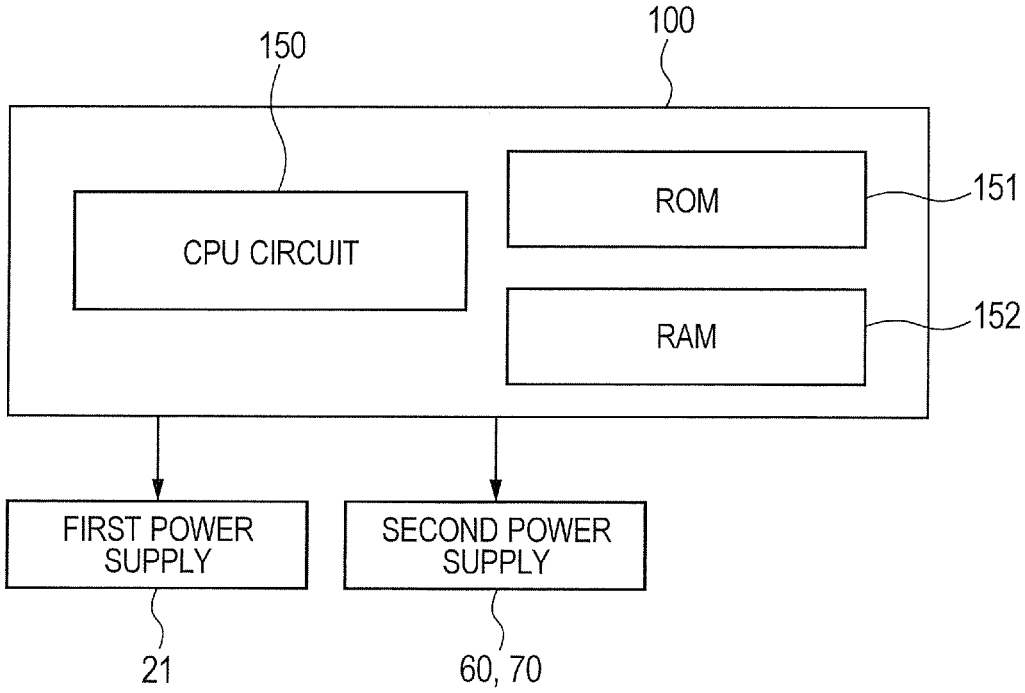
FIG. 12 is a diagram illustrating a controller and each power supply of the present invention.

A configuration of a controller 100 that controls the first power supply and the second power supply is described with reference to FIG. 12. The controller 100 includes a CPU circuit 150, as illustrated in FIG. 12. The CPU circuit 150 includes a built-in ROM 151 and a built-in RAM 152. The CPU circuit 150 controls the first power supply 21 and the second power supply 60 and 70 according to a control program stored in the ROM 151. An environment table and a paper thickness correspondence table are stored in the ROM 151, which are called up and utilized by the CPU. The RAM 152 temporarily stores control data, and is used as a workspace for computational processes involved with control. When image information and a print command are received from a host computer (not shown), the controller 100 controls the first power supply 21 and the second power supply 60 and 70 to supply current in the peripheral direction of the intermediate transfer belt 10.

Features of Embodiments of the Present Invention

An image forming apparatus according to an embodiment of the present invention may feature a configuration where a positive or negative polarity of a voltage applied to a primary transfer portion does not change when a positive or negative polarity of a voltage applied to a charging member during discharge-cleaning is switched. More specifically, even for cases where the positive or negative polarity of a voltage applied to the charging member is switched, current flowing from the secondary transfer member to the intermediate transfer belt 10 becomes dominant, and a voltage having a desired polarity can always be maintained stably in the primary transfer portion. Discharge-cleaning of the charging member and drum electrostatic cleaning of the primary transfer portion can thus be performed stable and in parallel, downtime can be reduced, and the lifetime of the image forming apparatus can be lengthened.

The resistance values of the secondary transfer roller 20 and the charging members (the conductive brush 16 and the conductive roller 17) in this embodiment are set as described above, and satisfy the following relationship:

The resistance value of the secondary transfer roller 20<The resistance value of the charging member (the conductive brush 16 and the conductive roller 17)

Figure 5:
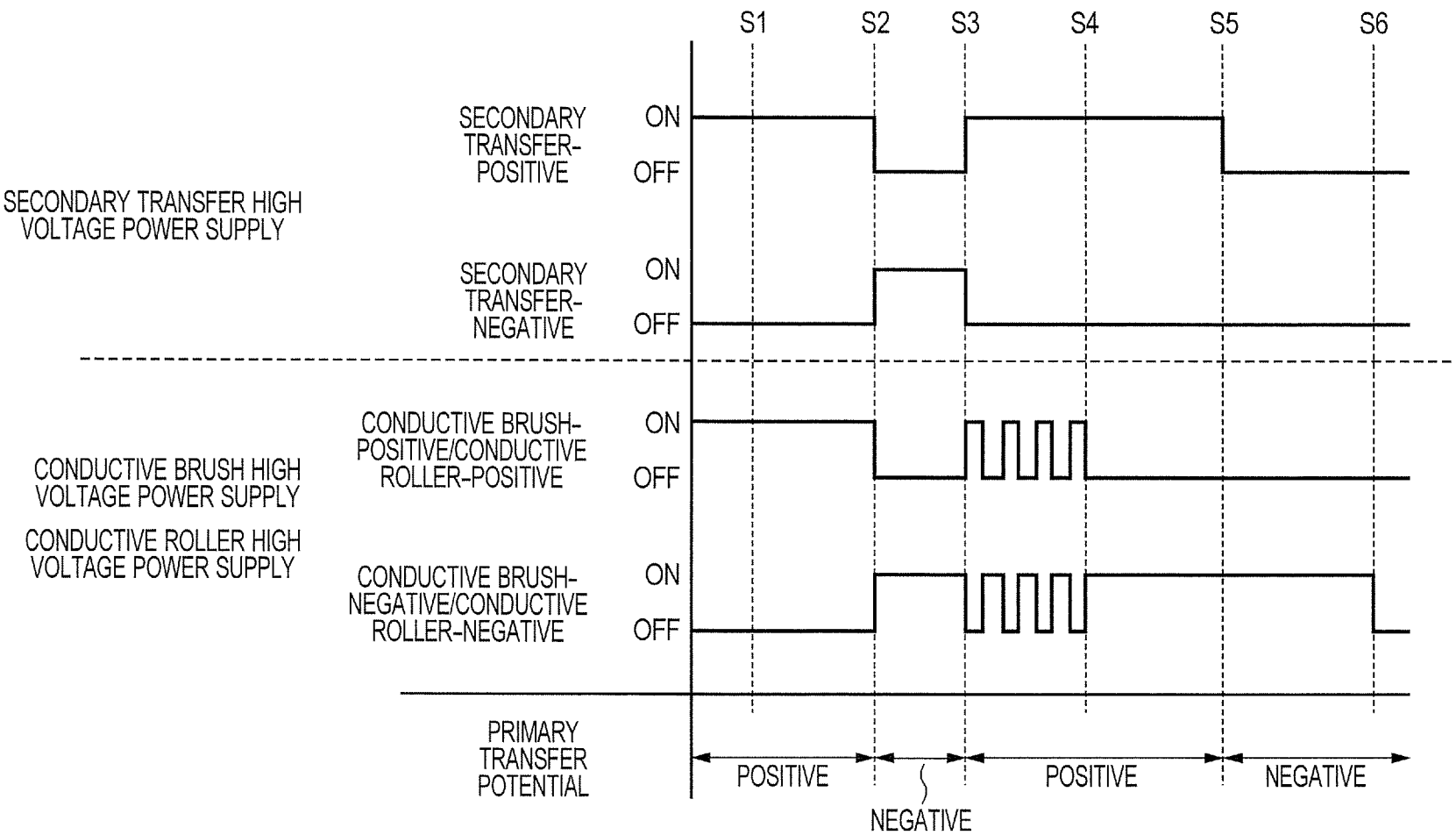
FIG. 5 is a timing chart for Embodiment 1 of the present invention.
Figure 6:
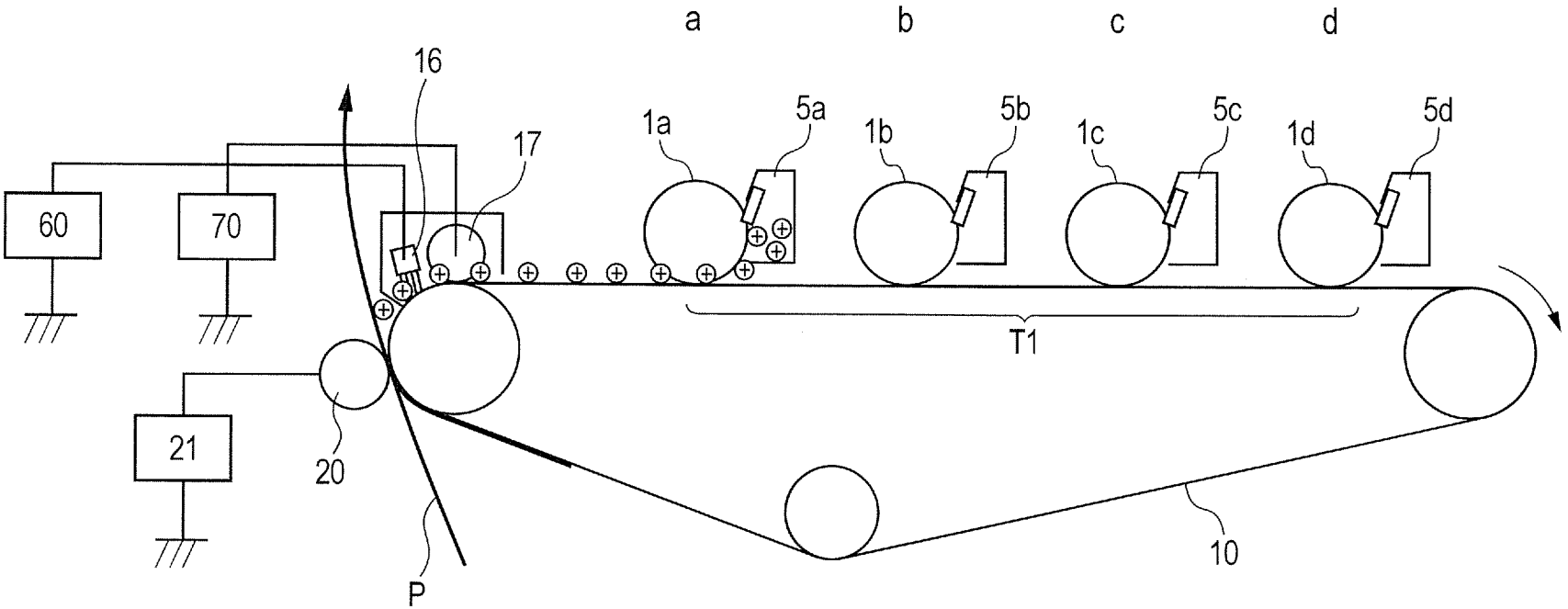
FIG. 6 is a diagram illustrating a toner state in Embodiment 1 of the present invention.

One feature of this embodiment is that the potential formed in the primary transfer portion is determined by the resultant current of the value of a current flowing from the secondary transfer roller 20 (first current value) and the value of a current flowing from the charging members (the conductive brush 16 and the conductive roller 17) (second current value). Further, the following relationship is satisfied even if the polarity of a voltage applied to the charging members (the conductive brush 16 and the conductive roller 17) is switched:

The value of current flowing from secondary transfer member>The value of current flowing from charging members Operation of Image Forming Apparatus Specific operation of the image forming apparatus according to this embodiment is described with reference to FIG. 5 to FIG. 9. FIG. 5 illustrates a post printing rotation operation timing chart in this embodiment. A timing S1 in FIG. 5 occurs during secondary transfer of a toner image from the intermediate transfer belt 10 to the recording material P, and FIG. 6 illustrates a toner state at this point. FIG. 6 illustrates a state where drum electrostatic cleaning collection at the first station a is performed while the remaining secondary transfer toner not transferred to the recording material P moves as is on the intermediate transfer belt 10. At this point, the secondary transfer high voltage power supply 21 applies a voltage of +800 V, the conductive brush high voltage power supply 60 and the conductive roller high voltage power supply 70 each apply a voltage of +1,500 V, and primary transfer is performed by a resultant current flowing from the secondary transfer roller 20 and from the charging members (the conductive brush 16 and the conductive roller 17). The current flowing in a primary transfer portion T1 during image forming is approximately +40 μA.

In a zone S1 to S2, at a point where image formation is complete in the primary transfer portion, surfaces of the photosensitive drums 1*a*, 1*b*, 1*c*, and 1*d* maintain substantially no electric potential, and from this point on the resultant current flows to the stretching roller (the driving roller 11, the tensioning roller 12, and the secondary transfer opposing roller 13) side. The potential on the rear surface of the intermediate transfer belt 10 is therefore maintained at +300 V hereafter in the primary transfer portion T1.

Figure 7:
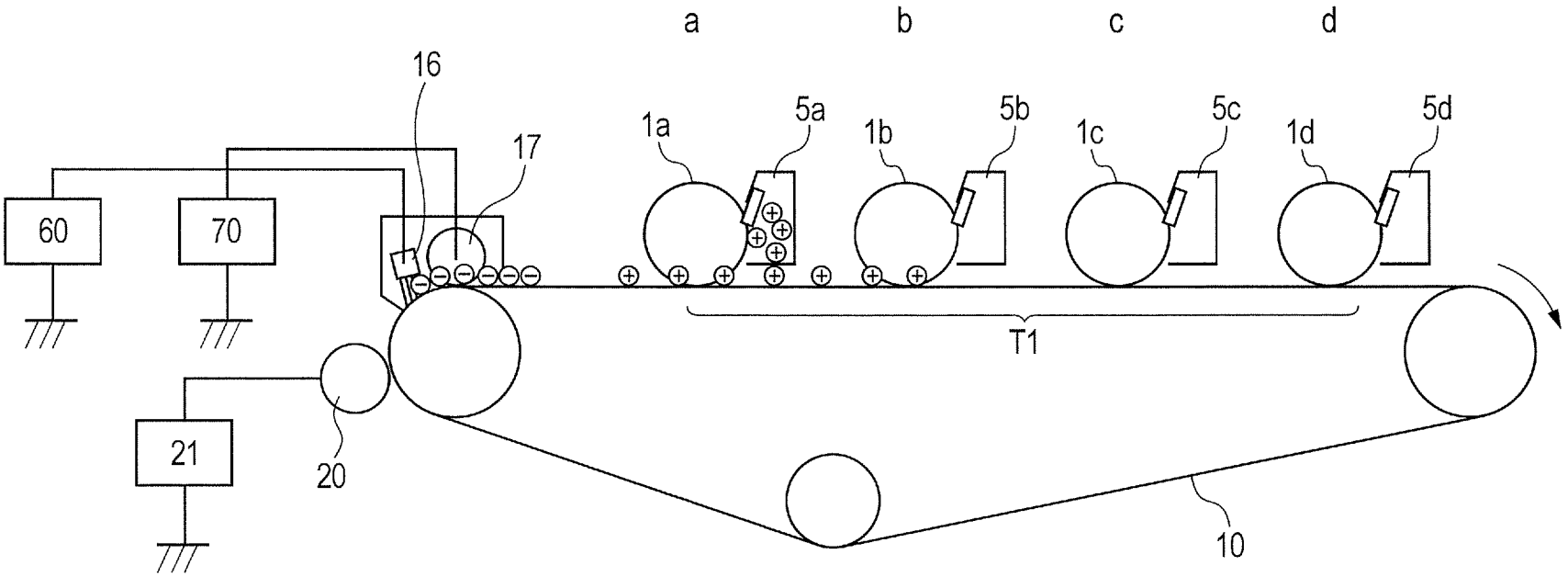
FIG. 7 is a diagram illustrating a toner state in Embodiment 1 of the present invention.

Next, at a point S2 where secondary transfer to the recording material P is complete, and the remaining secondary transfer toner arrives at the conductive roller 17, positive voltages from the secondary transfer high voltage power supply 21, the conductive brush high voltage power supply 60, and the conductive roller high voltage power supply 70 each switch off, while negative voltages therefrom switch on. The applied voltages are each −1,000 V. From the timing S2, the rear surface potential of the intermediate transfer belt 10 in the primary transfer portion T1 maintains −300 V due to the resultant current (approximately −70 μA, flowing from the secondary transfer roller 20 and from the charging members (the conductive brush 16 and the conductive roller 17). A trailing edge of the remaining secondary transfer toner that holds a positive charge is thus electrostatically attracted to the intermediate transfer roller 10 side. On the other hand, from the same point S2, negative polarity toner primarily collected on the conductive brush 16 is discharged from the conductive brush 16 and is moved while being charged more negatively by the conductive roller 17. The toner state at this point (a zone S2 to S3) is illustrated in FIG. 7. From FIG. 7, it is understood that a trailing edge of the remaining secondary transfer toner is electrostatically attracted to the intermediate transfer belt 10 without being collected by the first station a, and negative polarity toner is discharged from the conductive brush 16. The reason that the trailing edge of the remaining secondary transfer toner is not collected by the first station a is to avoid saturation of the cleaning device 5*a* with too much toner collection, and instead to distribute the toner among the cleaning devices 5*b*, 5*c*, and 5*d* of the stations b, c, and d. The trailing edge of the remaining secondary transfer toner is distributed and collected by the stations b and c in this embodiment.

Next, at a point S3 where the trailing edge of the remaining secondary transfer toner passes through the station a, a positive voltage from the secondary transfer high voltage power supply 21 is again turned on, and a negative voltage is turned off. Further, from the same point S3, repeatedly alternate switching between on and off states of positive and negative voltages from the conductive brush high voltage power supply 60 and from the conductive roller high voltage power supply 70 causes discharge-cleaning of the charging members (the conductive brush 16 and the conductive roller 17). Discharge-cleaning is complete at a point S4 where the positive voltage has been turned on and off four times.

The potential of the first transfer portion in the zone S3 to S4 is described. The secondary transfer high voltage power supply 21 applies a voltage of +1,000 V during the zone S3 to s4, and a +50 μA current flows in the secondary transfer roller 20. The conductive brush high voltage power supply 60, however, applies both +1,000 V and −1,000 V voltages. When a positive (+1,000 V) voltage is applied to the conductive brush 16, a current of +10 μA flows, while a current of −10 μA flows when a negative (−1,000 V) voltage is applied to the conductive brush 16. Further, both +1,000 V and −1,000 V voltages are applied to the conductive roller 17. When a positive (+1,000 V) voltage is applied to the conductive roller 17, a current of +10 μA flows, while a current of −10 μA flows when a negative (−1,000 V) voltage is applied to the conductive roller 17.

Therefore when the polarities of the conductive brush high voltage power supply 60 and the conductive roller high voltage power supply 70 are both positive, a current of +50 μA flows from the secondary transfer roller 20, and a current of +20 μA flows from the charging members (the conductive brush 16 and the conductive roller 17). The resultant current becomes equal to +70 μA, and therefore the rear surface potential of the intermediate transfer belt 10 maintains +300 V in the primary transfer portion T1. Further, when the conductive brush high voltage power supply 60 and the conductive roller high voltage power supply 70 both have a negative polarity, the current flowing from the secondary transfer roller 20 is +50 μA, and the current flowing from the charging members (the conductive brush 16 and the conductive roller 17) is −20 μA. The resultant current becomes +30 μA, and therefore the rear surface potential of the intermediate transfer belt 10 similarly maintains +300 V.

That is, in the zone S3 to S4, the rear surface potential of the intermediate transfer belt 10 is always maintained at +300 V. This is because even if the polarity of the voltage applied to the charging members (the conductive brush 16 and the conductive roller 17) is switched to be negative, the following relationship is satisfied, and the resultant current thus maintains a positive polarity:

The Absolute value of current flowing from the secondary transfer roller 20>The absolute value of current flowing from the charging members In other words, when the combined value of the current flowing from the secondary transfer roller 20 and the current flowing from the charging members is positive, it is possible for the primary transfer portion to maintain a positive potential.

Figure 8:
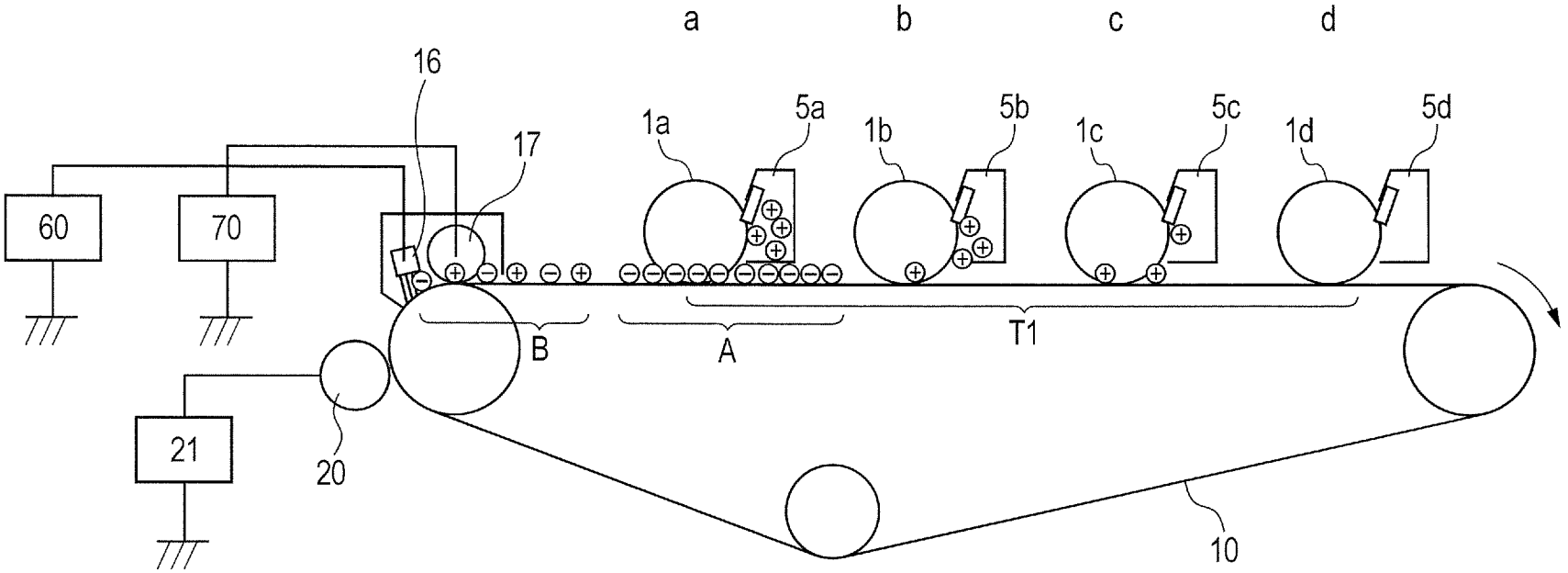
FIG. 8 is a diagram illustrating a toner state in Embodiment 1 of the present invention.

FIG. 8 is a diagram illustrating a toner state in the zone S3 to S4. From the point S3, a force acts to, electrostatically pull the remaining secondary transfer toner away from the intermediate transfer belt 10. Then, the remaining secondary transfer toner is drawn toward the photosensitive drums 1*a*, 1*b*, 1*c*, and 1*d*, and is collected by the cleaning devices 5*b* and 5*c* of the stations b and c. At this point, negative polarity toner A discharged from the conductive brush 16 passes through the station a in a state electrostatically attracted to the intermediate transfer belt 10. Further, toner B of positive and negative polarities is alternately discharged from the charging members (the conductive brush 16 and the conductive roller 17) due to discharge-cleaning of the charging members (the conductive brush 16 and the conductive roller 17).

Thereafter (from the point S4), with the positive polarity voltage (+1,000 V) from the secondary transfer high voltage power supply 21 in an on state, the positive polarity voltages from the conductive brush high voltage power supply 60 and from the conductive roller high voltage power supply 70 are turned off, and negative polarity voltages therefrom (−1,000 V) are turned on. The resultant current from the secondary transfer roller 20 and from the charging members (the conductive brush 16 and the conductive roller 17) becomes +30 μA, and the rear surface potential of the intermediate transfer belt 10 maintains +300 V in the primary transfer portion T1.

Figure 9:
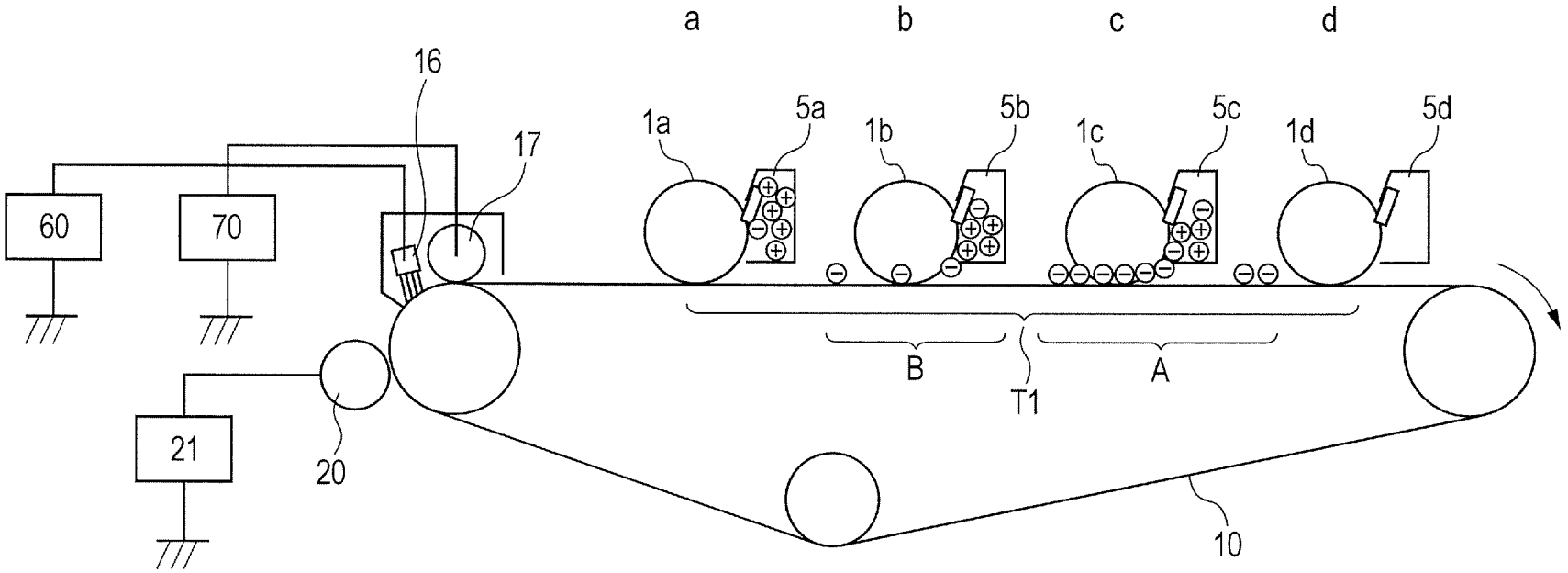
FIG. 9 is a diagram illustrating a toner state in Embodiment 1 of the present invention.

Next, at a point S5 where the positive and negative polarity toner B discharged due to discharge-cleaning of the charging members (the conductive brush 16 and the conductive roller 17) passes through the first station a, the positive polarity voltage from the secondary transfer high voltage power supply 21 is turned off. At this point, the resultant current of the charging members (the conductive brush 16 and the conductive roller 17) is −20 μA, and the rear surface potential of the intermediate transfer belt 10 maintains −300 V in the primary transfer portion t1. Therefore, from the point S5 a force acts to electrostatically pull the negative polarity toner A from the intermediate transfer belt 10 and draw the negative polarity toner A toward the photosensitive drums 1*a*, 1*b*, 1*c*, and 1*d*. FIG. 9 illustrates a state where the negative polarity toner A is distributed among the cleaning devices 5*b*, 5*c*, and 5*d* of the stations b, c, and d. Regarding the positive and negative polarity toner B discharged due to discharge-cleaning, before the point S5 where the positive polarity voltage of the secondary transfer high voltage power supply 21 is turned off, only the positive polarity toner is collected in the station a, while negative polarity toner passes through the station a. The negative polarity toner that has passed through the station a is collected by the stations b and c after the timing S5.

At a point S6 where all of the negative polarity toner is collected by the cleaning devices 5*b*, 5*c*, and 5*d* of the stations b, c, and d, the negative polarity voltages from the conductive brush high voltage power supply 60 and from the conductive roller high voltage power supply 70 are turned off, and a main motor of the image forming apparatus is turned off. A series of image forming operations is thus complete.

Operational Effects of this Embodiment

By maintaining the following relationship during post rotation operations after printing, as described above, even for cases where the polarity of the voltage applied to the charging members is switched, the polarity of the rear surface potential of the intermediate transfer belt 10 in the primary transfer portion does not change, and a stable voltage can be maintained:

The absolute value of current flowing from secondary transfer roller 20>The absolute value of current flowing from charging members Downtime can also be reduced because drum electrostatic cleaning in the primary transfer portion TI can be performed stably and in parallel with discharge-cleaning of the charging members (the conductive brush 16 and the conductive roller 17). Further, toner having different polarities of positive and negative, such as the remaining secondary transfer toner and the toner discharged from the charging members, can be promptly distributed and collected with good efficiency among each image forming station, and image forming operations can be stopped at an early timing. The amount of time that the photosensitive drums 1*a*, 1*b*, 1*c*, and 1*d* and the intermediate transfer belt 10 spend rotating can be reduced, and the lifetime of the image forming apparatus can be extended.

Note that, although the Zener diodes 15*a* and 15*b* are connected to each of the three stretching rollers 11, 12, and 13 in this embodiment, Zener diodes may instead be connected to only one or two of the stretching rollers.

Further, a conductive member such as a metal roller may be disposed in the vicinity of the photosensitive drums 1*a*, 1*b*, 1*c*, and 1*d* at the primary transfer portion of each image forming station, and may be connected to the Zener diodes 15*a* and 15*b* similarly to the stretching rollers (the driving roller 11, the tensioning roller 12, and the secondary transfer opposing roller 13).

In this embodiment, the Zener diodes 15*a* and 15*b* are used as voltage stabilizing elements (constant voltage element s) to maintain the surface potential of the inner peripheral surface of the intermediate transfer belt equal to, or greater than, a predefined potential having the same polarity as the resultant current. However, other voltage stabilizing elements may also be used provided that a similar effect can be maintained. For example, elements such as a varistor may also be used.

The resistance values of the secondary transfer roller 20, the conductive brush 16, and the conductive roller 17 may also all be set to $1\times10^8\Omega$ (variation 1). That is, the following relationship is satisfied.

The resistance value of Secondary transfer roller 20=The resistance value of the charging member (the conductive brush 16, the conductive roller 17)

In this case, during discharge-cleaning of the charging members (the conductive brush 16 and the conductive roller 17), the applied voltage from the secondary transfer high voltage power supply 21 is +2,500 V, and the applied voltages from the conductive brush high voltage power supply 60 and from the conductive roller high voltage power supply 70 are +1,000 V or −1,000 V. That is, the following relationship for applied voltages (absolute values) is satisfied:

The absolute value of voltage applied to the secondary transfer roller 20>The absolute value of voltage applied to the charging members (the conductive brush 16, the conductive roller 17)

At this point, a current of +25 μA flows in the secondary transfer roller in the zone S3 to S4. Currents of +10 μA flow in the charging members (the conductive brush 16 and the conductive roller 17) when a positive polarity voltage of +1,000 V is applied, while currents of −10 μA flow in the charging members when a negative polarity voltage of −1,000 V is applied. The resultant current therefore becomes +45 μA when the conductive brush high voltage power supply 60 and the conductive roller high voltage power supply 70 both have a positive polarity, while the resultant current becomes +5 μA when both have a negative polarity. In each case, the resultant current is positive. The rear surface potential of the intermediate transfer belt 10 can therefore maintain +300 V in the primary transfer portion T1.

As described above, the following relationship is satisfied by the configuration of variation 1 even for cases where the positive and negative polarities of the voltage applied from the conductive brush high voltage power supply 60 and from the conductive roller high voltage power supply 70 to the charging members are switched:

The absolute value of current flowing from the secondary transfer roller 20>the absolute value of current flowing from charging members Therefore, a stable voltage can be maintained, without changes in polarity of the rear surface potential of the intermediate transfer belt 10 in the primary transfer portion, in this variation as well.

The resistance value of the secondary transfer roller 20 may be $1\times10^{8}\Omega$, and the resistance values of the conductive brush 16 and the conductive roller 17 may both be set to $5\times10^{7}\Omega$ (variation 2). That is, the following relationship is satisfied.

The resistance value of the secondary transfer roller 20>The resistance value of the charging members (the conductive brush 16, the conductive roller 17)

In this case, during discharge-cleaning of the charging members (the conductive brush 16 and the conductive roller 17), the applied voltage from the secondary transfer high voltage power supply 21 is +2,500 V, and the applied voltages from the conductive brush high voltage power supply 60 and from the conductive roller high voltage power supply 70 are +500 V or −500 V. That is, the following relationship for applied voltages (absolute values) is satisfied:

The absolute value of voltage applied to the secondary transfer roller 20>the absolute value of voltage applied to the charging members (the conductive brush 16, the conductive roller 17)

At this point, a current of +25 μA flows in the secondary transfer roller in the zone S3 to S4. Currents of +10 μA flow in the charging members (the conductive brush 16 and the conductive roller 17) when a positive polarity voltage of +500 V is applied, while currents of −10 μA flow in the charging members when a negative polarity voltage of −500 V is applied. The resultant current therefore becomes +45 μA when the conductive brush high voltage power supply 60 and the conductive roller high voltage power supply 70 both have a positive polarity, while the resultant current becomes +5 μA when both have a negative polarity. In each case, the resultant current is positive. The rear surface potential of the intermediate transfer belt 10 can therefore maintain +300 V in the primary transfer portion T1.

As described above, the following relationship is satisfied by the configuration of variation 2 even for cases where the positive and negative polarities of the voltage applied from the conductive brush high voltage power supply 60 and from the conductive roller high voltage power supply 70 to the charging members are switched:

The absolute value of current flowing from the secondary transfer roller 20>The absolute value of current flowing from charging members Therefore, a stable voltage can be maintained, without changes in polarity of the rear surface potential of the intermediate transfer belt 10 in the primary transfer portion, in this variation as well.

The resistance value of the secondary transfer roller 20 may be $2\times10^{7}\Omega$, and the resistance values of the conductive brush 16 and the conductive roller 17 may both be set to $2\times10^{9}\Omega$ (variation 3). That is, the following relationship is satisfied:

The resistance value of the secondary transfer roller 20<The resistance value of the charging members (the conductive brush 16, the conductive roller 17)

In this case, during discharge-cleaning of the charging members (the conductive brush 16 and the conductive roller 17), the applied voltage from the secondary transfer high voltage power supply 21 is +800 V, and the applied voltages from the conductive brush high voltage power supply 60 and from the conductive roller high voltage power supply 70 are +1,000 V or −1,000 V. That is, the following relationship for applied voltages (absolute values) is satisfied:

The absolute value of voltage applied to the secondary transfer roller 20<The absolute value of voltage applied to the charging members (the conductive brush 16, the conductive roller 17)

At this point, a current of +40 μA flows in the secondary transfer roller in the zone S3 to S4. Currents of +0.5 μA flow in the charging members (the conductive brush 16 and the conductive roller 17) when a positive polarity voltage of +1,000 V is applied, while currents of −0.5 μA flow in the charging members when a negative polarity voltage of −1,000 V is applied. The resultant current therefore becomes +41 μA when the conductive brush high voltage power supply 60 and the conductive roller high voltage power supply 70 both have a positive polarity, while the resultant current becomes +39 μA when both have a negative polarity. In each case, the resultant current is positive. The rear surface potential of the intermediate transfer belt 10 can therefore maintain +300 V in the primary transfer portion T1.

As described above, the following relationship is satisfied by the configuration of variation 3 even for cases where the positive and negative polarities of the voltage applied from the conductive brush high voltage power supply 60 and from the conductive roller high voltage power supply 70 to the charging members are switched:

The absolute value of current flowing from the secondary transfer roller 20>The absolute value of current flowing from charging members Therefore, a stable voltage can be maintained, without changes in polarity of the rear surface potential of the intermediate transfer belt 10 in the primary transfer portion.

Embodiment 2

An image forming apparatus according to Embodiment 2 of the present invention is described. In the configuration of the image forming apparatus according to this embodiment, the same members as those of Embodiment 1 are denoted by the same reference symbols, and description thereof is omitted. Matters not described here are similar to those in Embodiment 1.

Features of this Embodiment

Figure 10:
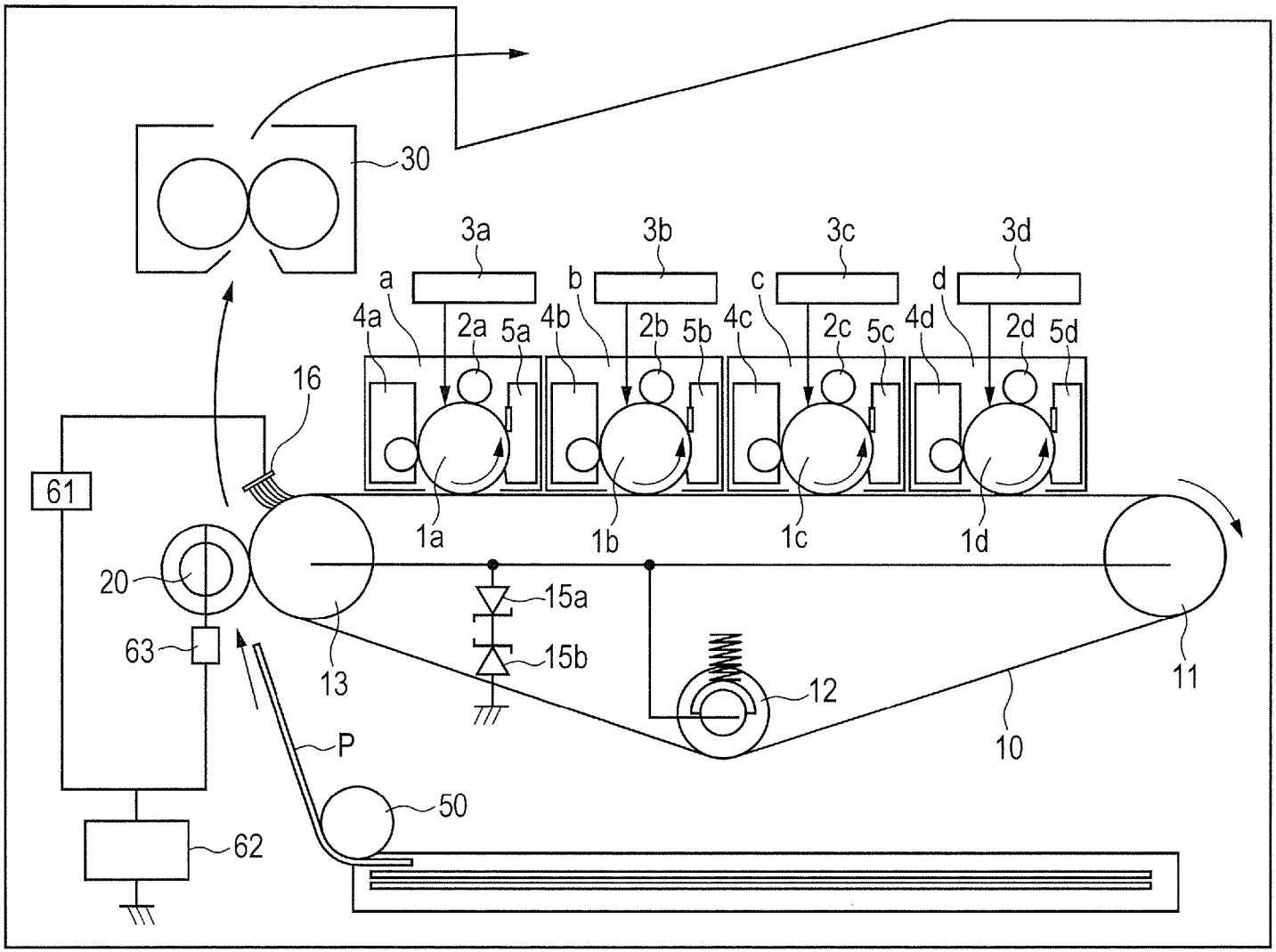
FIG. 10 is a schematic configuration diagram of an image forming apparatus according to Embodiment 2 of the present invention.

FIG. 10 is a schematic configuration diagram of the image forming apparatus according to Embodiment 2 of the present invention. FIG. 10 illustrates that one feature of the image forming apparatus in this embodiment is that a conductive roller is not used as the charging member as in Embodiment 1, and only the conductive brush 16 is used.

A surface of the intermediate transfer belt 10 used in this embodiment is coated with a 2 μm thickness of an acrylic resin coating material, thereby forming a highly smooth coating layer. A base layer is formed from a material having polyester as its main component, with a thickness of 100 μm, similar to that used in Embodiment 1. As a result, the volume resistivity of the intermediate transfer belt 10 becomes $1\times10^9$ Ω·cm, and the resistance value of the intermediate transfer belt 10 in a portion contacting the conductive brush 16 becomes $8.9\times10^5$Ω. Increasing the smoothness of the coating layer of the intermediate transfer belt 10 makes it possible to reduce the size of minute spaces that develop between the coating layer of the intermediate transfer belt 10 and a recording material surface, and this can reduce electric field disturbances at the secondary transfer portion, and increase secondary transfer efficiency. As a result, the amount of remaining secondary transfer toner can be reduced, and the amount of toner that needs to be given a positive polarity charge is sufficiently reduced to a level capable of being handled by the primary collection capability of the conductive brush 16. The remaining secondary transfer toner can therefore be charged with a positive polarity by using only the conductive brush 16.

Materials similar to those of Embodiment 1 may be used in configuring the conductive brush 16. The resistance value per unit length of one conductive fiber 16*a* is $1\times10^{12}$ Ω/cm, the resistance value of the conductive brush 16 is $1\times10^8$Ω, and the single fiber fineness is 300 T/60 F (5 dtex). The brush density is 100 kF/inch$^2$.

One more feature of this embodiment is that a negative polarity voltage is applied in common to the secondary transfer roller 20 and to the conductive brush 16. Individual positive polarity voltages are applied from respective high voltage power supplies (a secondary transfer positive high voltage power supply 63 and a conductive brush positive high voltage power supply 61), and a negative polarity voltage is applied from a common line power supply 62. This allows a reduction in costs because one negative polarity high voltage power supply can be eliminated.

Image Forming Apparatus Operation

Figure 11:
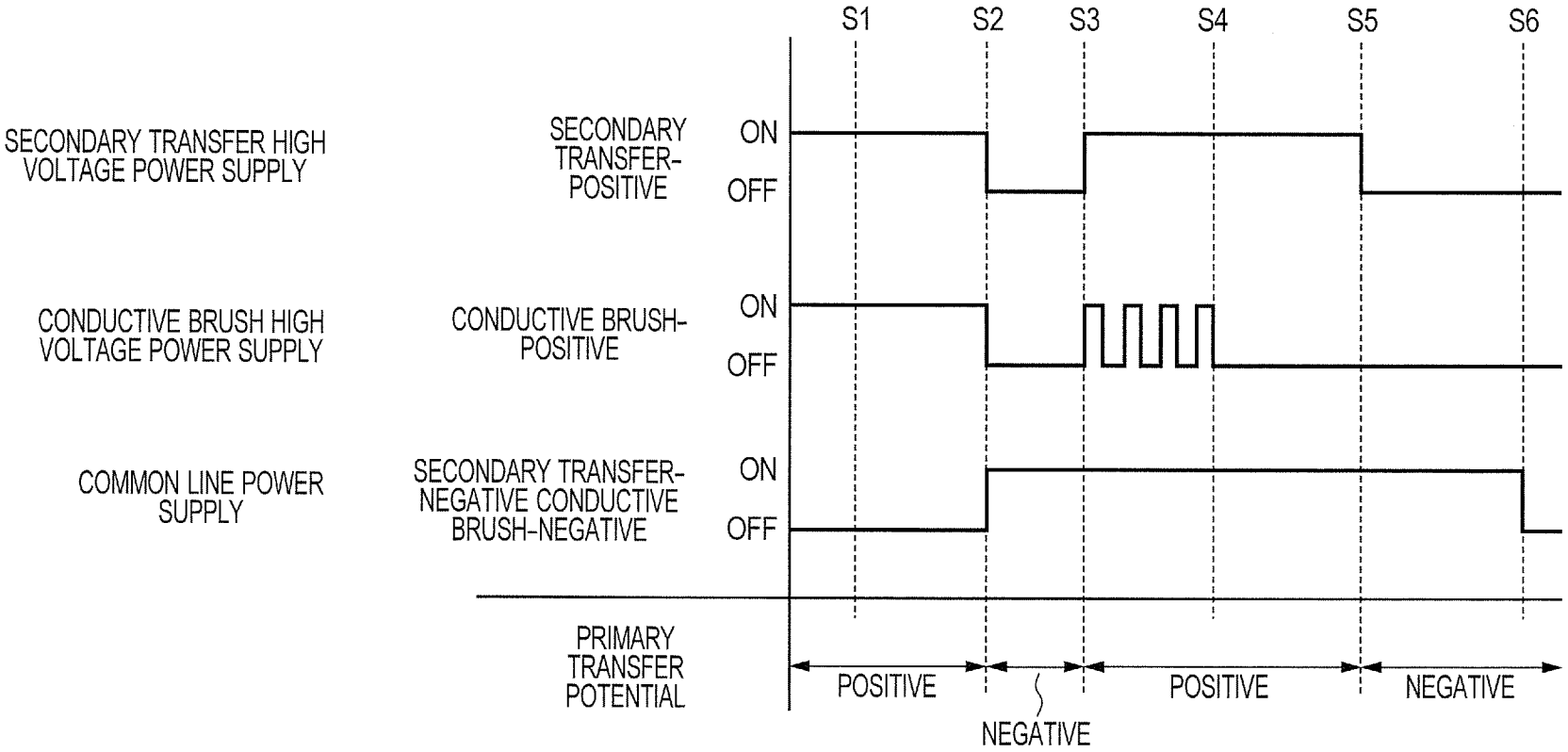
FIG. 11 is a post rotation timing chart for Embodiment 2 of the present invention.

Specific operations of the image forming apparatus having the above features is described using FIG. 11. FIG. 11 illustrates a post rotation operation timing chart following printing in this embodiment. Respective timings S1 to S6 in FIG. 11 are similar to those of Embodiment 1, and toner states at each timing are similar to those illustrated in FIGS. 6 to 9. Specific descriptions are thus omitted here, and only points of difference are described.

At the timing S1, the secondary transfer high voltage power supply applies a voltage of +800 V, and the conductive brush high voltage power supply 62 applies a voltage of +1,500 V. The current flowing in the primary transfer portion T1 at this point is approximately +35 μA. Further, in the zone S1 to S2, the rear surface potential of the intermediate transfer belt 10 in the primary transfer portion T1 is maintained at +300 V after image forming in the primary transfer portion T1 is complete.

At the timing S2, the secondary transfer high voltage power supply 61 and the conductive brush high voltage power supply 62 are both turned off, and the common line power supply 63 is turned on. The applied voltage is −1,000 V. From the timing S2, the resultant current of the currents flowing from the secondary transfer roller 20 and the conductive brush 16 (approximately −60 μA) maintains the rear surface potential of the intermediate transfer belt 10 at −300 V in the primary transfer portion T1.

At the timing S3, the secondary transfer high voltage power supply 61 is again turned on. Discharge-cleaning of the conductive brush 16 is performed by alternately and repeatedly switching on and off of the conductive brush high voltage power supply 62. Discharge-cleaning is complete at the point (the timing S4) where the positive polarity voltage has been turned on and off four times. In this zone S3 to S4, the common line power supply 63 remains on. This is a circuit structure (not shown) where positive voltage is dominant for the secondary transfer roller 20 and the conductive brush 16 for cases where a positive voltage is applied, even if a negative voltage is in an on state. Therefore, a positive current always flows in the secondary transfer roller 20. A positive current flows in the conductive brush 16 when the conductive brush high voltage power supply 62 is on, while a negative current flows when the conductive brush high voltage power supply 62 is off.

At this point, the secondary transfer high voltage power supply 61 applies a voltage of +1,000 V, and a current of +50 μA flows in the secondary transfer roller. The conductive brush high voltage power supply 62 applies a voltage of +1,000 V, and the common line power supply 63 applies a voltage of −1,000 V. A current of +10 μA flows in the conductive brush 16 when the conductive brush high voltage power supply 62 is on, while a current of −10 μA flows in the conductive brush 16 when the conductive brush high voltage power supply 62 is off.

The resultant current from the secondary transfer roller 20 and the conductive brush 16 therefore becomes +60 μA when the conductive brush high voltage power supply 62 is on, and becomes +40 μA when the conductive brush high voltage power supply 62 is off. That is, the resultant current is positive for all cases, and therefore the rear surface potential of the intermediate transfer belt 10 in the primary transfer portion T1 is maintained at +300 V. This is because even when the polarity of the voltage applied to the charging member (the conductive brush 16) is switched to a negative polarity, the resultant current maintains a positive polarity by satisfying the following relationship:

The absolute value of current flowing from secondary transfer roller 20>The absolute value of current flowing from charging member From the timing S4 onward, the secondary transfer high voltage power supply 61 remains in an on state, the conductive brush high voltage power supply 62 is placed in an off state, and the common line power supply 63 remains on. At this point, the resultant current from the secondary transfer roller 20 and the conductive brush 16 becomes +40 μA, and the rear surface potential of the intermediate transfer belt 10 in the primary transfer portion T1 is maintained at +300 V.

At the timing S5, the secondary transfer high voltage power supply 61 is turned off. At this point, only a −10 μA current from the conductive brush 16 flows, and the rear surface potential of the intermediate transfer belt 10 in the primary transfer portion T1 is maintained at −300 V.

At the timing S6, the common line power supply 63 is turned off, and a main motor of the image forming apparatus is turned off. A series of image forming operations is thus complete.

Operational Effects of this Embodiment

In this embodiment, costs can be reduced because the conductive roller 17 is not used as the charging member. Costs can also be reduced because a negative polarity high voltage power supply can be shared between the secondary transfer roller 20 and the conductive brush 16. Other operational effects are similar to those of Embodiment 1.

Note that, although the Zener diodes 15*a* and 15*b* are connected to each of the three stretching rollers 11, 12, and 13 in this embodiment, Zener diodes may instead be connected to only one or two of the stretching rollers.

Further, a conductive member such as a metal roller may be disposed at a portion opposing to the photosensitive drums 1*a*, 1*b*, 1*c*, and 1*d* in the primary transfer portion of each image forming station, and may be connected to the Zener diodes 15*a* and 15*b* similarly to the stretching rollers (the driving roller 11, the tensioning roller 12, and the secondary transfer opposing roller 13).

In this embodiment, the Zener diodes 15*a* and 15*b* are used as voltage stabilizing elements. However, other voltage stabilizing elements may also be used provided that a similar effect can be maintained. For example, elements such as a varistor may also be used.

Cases where the normal charging polarity of the toner is negative have been described in Embodiment 1 and Embodiment 2. The present invention may also be applied to cases where the normal charging polarity is positive, however. Note that, when positive polarity toner is used, the following relationship may be satisfied so that a resultant current flows to maintain a negative polarity for the rear surface potential of the intermediate transfer belt in the primary transfer portion may be employed. The relationship is that the combined value of the current flowing from the secondary transfer roller 20 and the current flowing from the toner charging member is negative.

Embodiment 3

An image forming apparatus according to Embodiment 3 of the present invention is described. In the configuration of the image forming apparatus according to this embodiment, the same members as those of Embodiment 1 are denoted by the same reference symbols, and description thereof is omitted. Matters not described here are similar to those in Embodiment 1.

Features of this Embodiment

An object of Embodiment 1 is to control variations in the polarity of the primary transfer portion potential when performing discharge-cleaning. An object of this embodiment, however, is to control variations in the polarity of the primary transfer portion potential when applying a holding voltage to the charging device so that toner does not drop off of the charging device.

Image Forming Apparatus Operation

Figure 13:
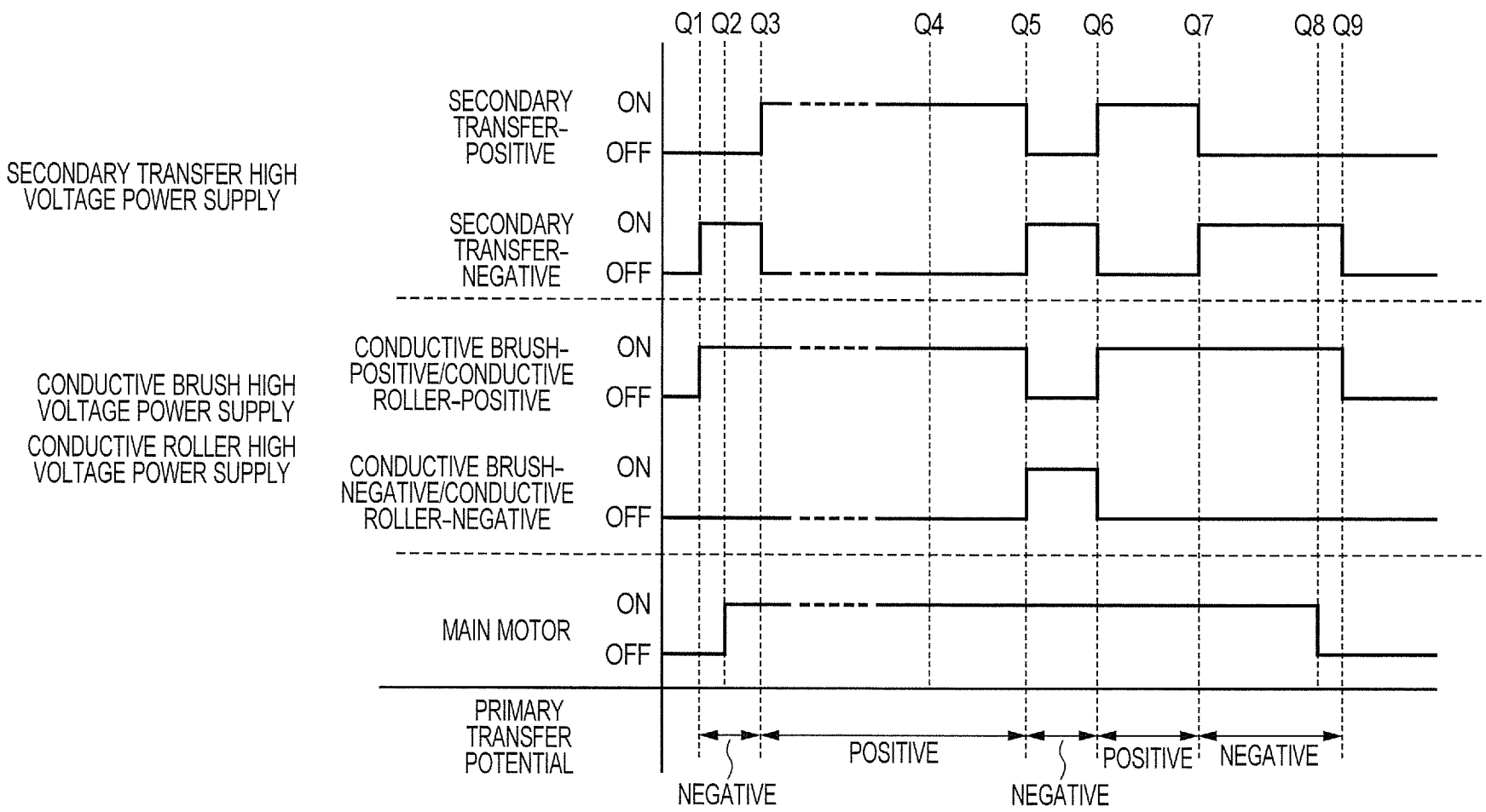
FIG. 13 is a timing chart for Embodiment 3 of the present invention.

Specific operation of the image forming apparatus according to Embodiment 3 is described with reference to FIGS. 13 to 17. FIG. 13 illustrates a timing chart for printing operations in Embodiment 3. FIGS. 14 to 17 illustrate toner states in Embodiment 3.

In FIG. 13, Q1 is a timing at which an image forming apparatus receives an image signal, and at which image forming operations begin. At this point (the timing Q1), a negative polarity voltage from the secondary transfer high voltage power supply 21, and positive polarity voltages from the conductive brush high voltage power supply 60 and the conductive roller high voltage power supply 70 are turned on. The voltage applied by the secondary transfer high voltage power supply 21 is −1,000 V, and a current of −50 μA flows in the secondary transfer roller 20. Further, the voltages applied by the conductive brush high voltage power supply 60 and the conductive roller high power supply 70 are both +1,000 V. The currents flowing in the conductive brush 16 and the conductive roller 17 are both +10 μA.

Figure 15:
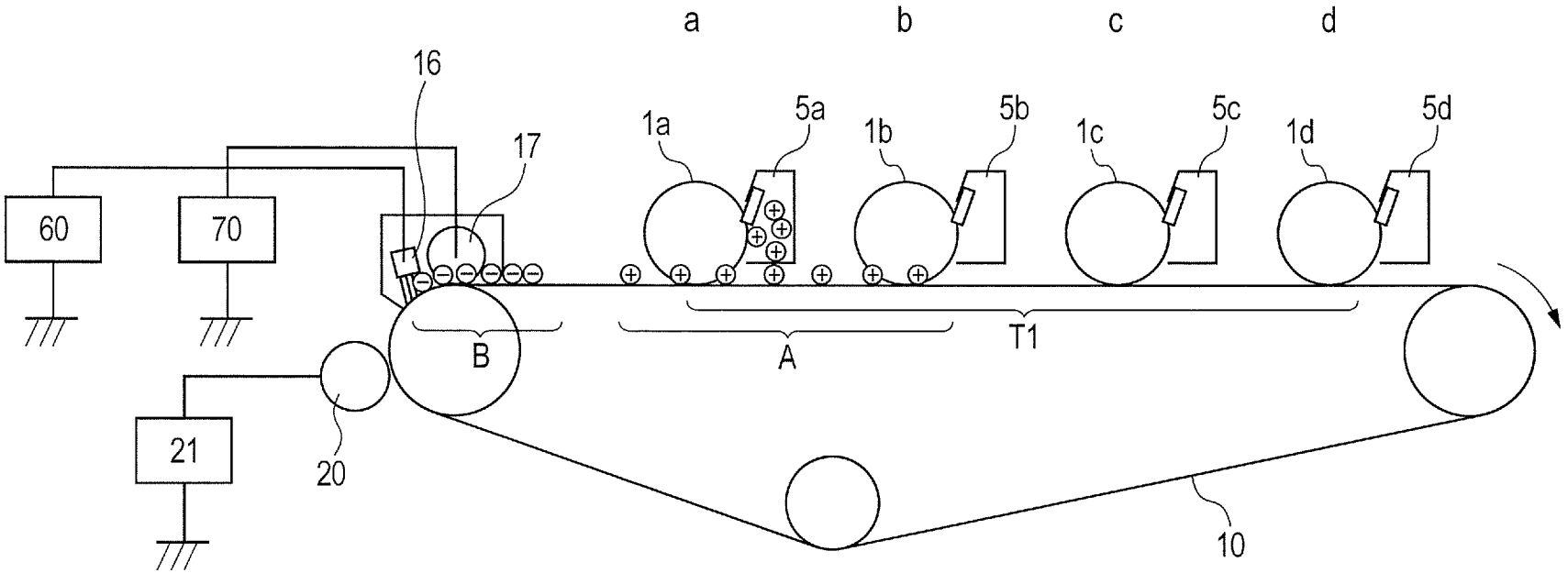
FIG. 15 is a diagram illustrating a toner state in Embodiment 3 of the present invention.

The resultant current flowing from the secondary transfer roller 20 and the charging devices (the conductive brush 16 and the conductive roller 17) therefore becomes −30 μA, and the rear surface potential of the intermediate transfer belt 10 is thus maintained at −300 V in each primary transfer portion T1 (refer to FIG. 15). This is because satisfying the following relationship maintains the resultant current at a negative polarity even when the polarity of a voltage applied to the toner charging devices (the conductive brush 16 and the conductive roller 17) is positive.

The relationship is that the combined value of the current flowing from the secondary transfer roller 20 and the current flowing from the charging devices is negative.

As illustrated in FIG. 13, before a main motor turns on (before image forming operations begin), positive polarity voltages of the conductive brush high voltage power supply 60 and the conductive roller high voltage power supply 70 are turned on. This is performed in order to suppress transfer of negative polarity toner on the conductive brush 16 onto the intermediate transfer belt 10 (toner drop) when the intermediate transfer belt 10 moves after rotation drive operations begin. In consideration of voltage rise time, in Embodiment 3, the positive polarity voltages of the conductive brush high voltage power supply 60 and the conductive roller high voltage power supply 70 are turned on 200 ms before the main motor is turned on, thereby applying positive polarity holding voltage 5 to the conductive brush 16 and the conductive roller 17.

FIG. 13 illustrates a negative polarity voltage of the secondary transfer high voltage power supply 21 turned on at the same time. This is performed in order to suppress discharge on the positive polarity side to the photosensitive drums 1*a*, 1*b*, 1*c*, and 1*d* in each of the primary transfer portions T1 by maintaining the rear surface potential of the intermediate transfer belt 10 at a negative polarity even when the positive polarity voltages of the conductive brush high voltage power supply 60 and the conductive roller high voltage power supply 70 are on. In Embodiment 3, the rear surface potential of the intermediate transfer belt 10 is maintained at −300 V.

Figure 14:
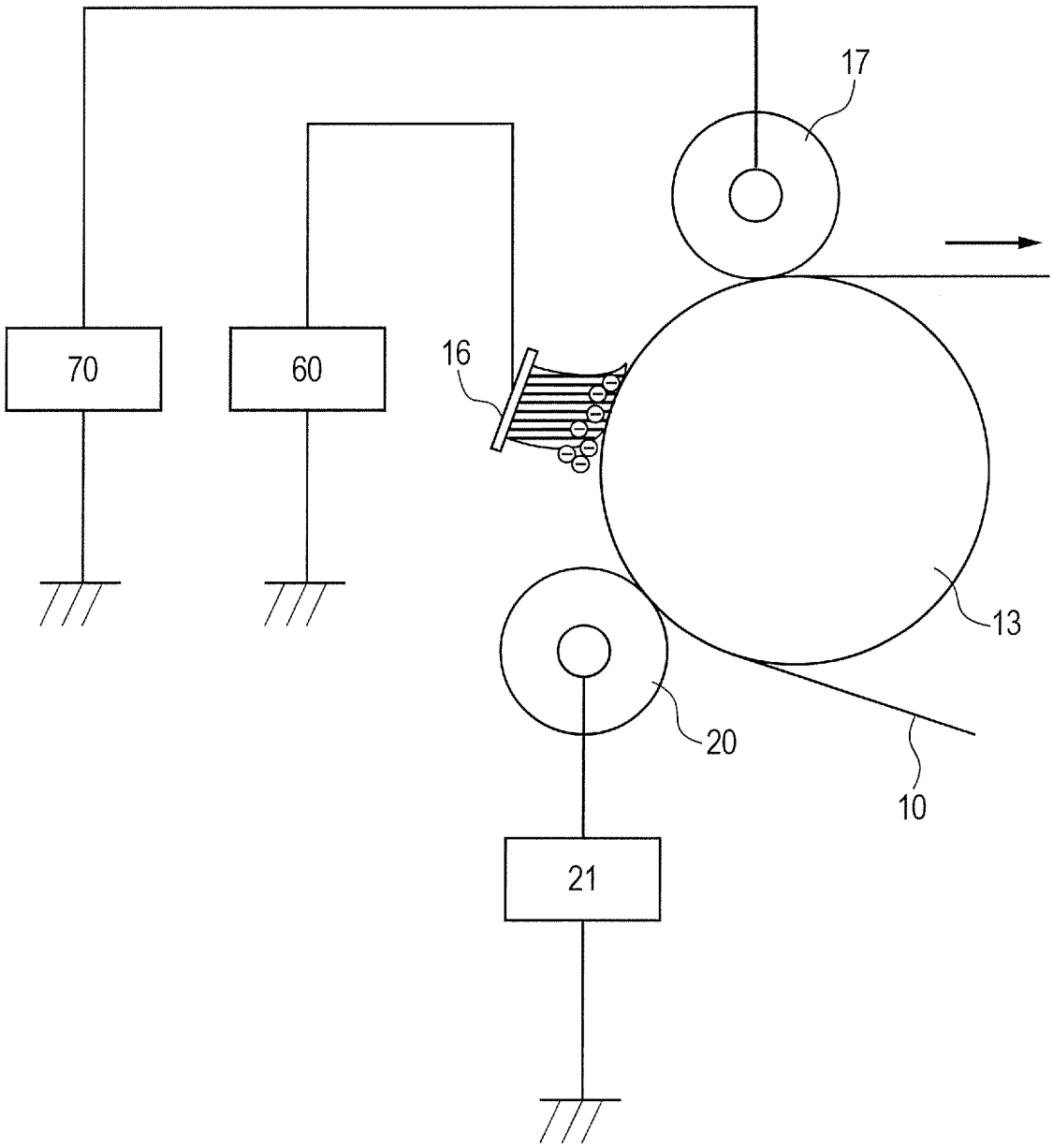
FIG. 14 is a diagram illustrating a toner state in Embodiment 3 of the present invention.

Next, the main motor is turned on at a point Q2 where the positive polarity voltages of the conductive brush high voltage power supply 60 and the conductive roller high voltage power supply 70 have risen up. Drive of rotating bodies within the image forming apparatus, such as the intermediate transfer belt 10 and the photosensitive drums 1*a*, 1*b*, 1*c*, and 1*d*, thus begins. At this point, negative polarity toner temporarily collected by the conductive brush 16 does not influence the image formation because, as illustrated in FIG. 14, the intermediate transfer belt 10 moves in the direction of an arrow illustrated in FIG. 14 with the toner held by the conductive brush 16.

Next, at a point Q3 where image formation preparations in the photosensitive drums 1*a*, 1*b*, 1*c*, and 1*d* are complete, the positive polarity voltage of the secondary transfer high voltage power supply 21 is turned on, and the negative polarity voltage thereof is turned off. The applied voltage is +800 V. Further, with the applied voltages of the conductive brush high voltage power supply 60 and the conductive roller high voltage power supply 70 at +1,000 V, primary transfer is performed by the resultant current flowing from the secondary transfer roller 20 and the toner charging members (the conductive brush 16 and the conductive roller 17). A current of approximately +40 μA flows in the primary transfer nip portion T1 during image formation.

Next, at a point Q4 where primary transfer processes in all of the image forming stations a, b, c, and d are complete, surfaces of the photosensitive drums 1*a*, 1*b*, 1*c*, and 1*d* hold nearly no electric potential, and thus the resultant current flows toward the stretching rollers (the driving roller 11, etc. from this timing. The rear surface potential of the intermediate transfer belt 10 in the primary transfer nip portion T1 is therefore maintained at +300 V from this timing onward.

Operations from the timing Q4 onward in Embodiment 3 are referred to as post rotation operations. During the post rotation operations, the positive and negative polarity voltages of the secondary transfer high voltage power supply 21, the conductive brush high voltage power supply 60, and the conductive roller high voltage power supply 70 are turned on and off. This is performed in order to perform control so that positive and negative polarity toner on the secondary transfer roller 20 and on the conductive brush 16 is discharged onto the intermediate transfer belt 10 (discharge-cleaning), and is distributed uniformly to the cleaning devices 5*a*, 5*b*, 5*c*, and 5*d* of the first to fourth stations a, b, c, and d to be collected.

For example, in a zone Q5 to Q6, the positive polarity voltage of the secondary transfer high voltage power supply 21, and the positive polarity voltages of the conductive brush high voltage power supply 60 and the conductive roller high voltage power supply 70 are turned off. Then, the negative polarity voltage of the secondary transfer high voltage power supply 21, and the negative polarity voltages of the conductive brush high voltage power supply 60 and the conductive roller high voltage power supply 70 are turned on. The applied voltages are all −1,000 V. From the timing Q5, the resultant current flowing from the secondary transfer roller 20 and from the toner charging members (the conductive brush 16 and the conductive roller 17) is approximately −70 μA, which causes the rear surface potential of the intermediate transfer belt 10 to maintain −300 V in the primary transfer nip portion T1.

FIG. 15 illustrates a toner state at this point. Remaining secondary transfer toner A has a positive polarity electric charge, and moves by being electrostatically attracted to the intermediate transfer belt 10. Negative polarity toner B primarily collected in the conductive brush 16 is discharged from the conductive brush 16 and moves while being further negatively charged by the conductive roller 17.

In a zone Q6 to Q7, a positive polarity voltage of the secondary transfer high voltage power supply 21 is turned on, and a negative polarity voltage thereof is turned off. Further, positive polarity voltages of the conductive brush high voltage power supply 60 and the conductive roller high voltage power supply 70 are turned on, and negative polarity voltages thereof are turned off. The secondary transfer high voltage power supply 21 applies a voltage of +1,000 V, and a current of +50 μA flows in the secondary transfer roller 20. The voltages applied by the conductive brush high voltage power supply 60 and the conductive roller high voltage power supply 70 are each +1,000 V, and currents of +10 μA flow in both the conductive brush 16 and the conductive roller 17. Therefore, the resultant current flowing from the secondary transfer roller 20 and the toner charging members (the conductive brush 16 and the conductive roller 17) becomes +70 μA, and the rear surface potential of the intermediate transfer belt 10 is thus maintained at +300 V in the primary transfer nip portion T1.

From the same timing Q6, discharging of the negative polarity toner B stops in the toner charging members (the conductive brush 16 and the conductive roller 17), and a trace amount of negative polarity toner on the intermediate transfer belt 10 is thereafter primarily collected by the conductive brush 16.

Figure 16:
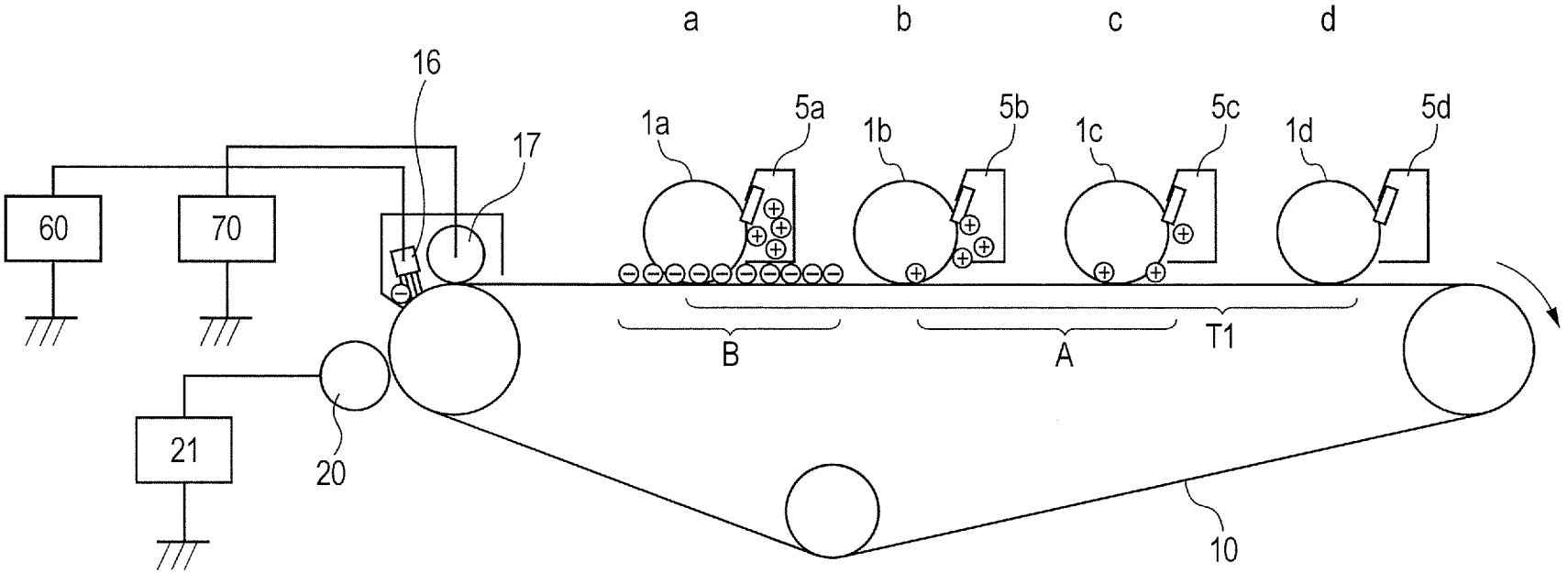
FIG. 16 is a diagram illustrating a toner state in Embodiment 3 of the present invention.

FIG. 16 is a toner state diagram from the point Q6 onward. From the timing Q6, a force acts to electrostatically pull the remaining secondary transfer toner A away from the intermediate transfer belt 10. Then, the remaining secondary transfer toner A is drawn toward the photosensitive drums 1*a*, 1*b*, 1*c*, and 1*d*, and is collected in the cleaning devices 5*b* and 5*c* of the second and the third image forming stations b and c. At this time, the negative polarity toner B discharged from the conductive brush 16 passes through the first image forming station a in a state of being electrostatically attracted to the intermediate transfer belt 10. This is because the rear surface potential of the intermediate transfer belt 10 is maintained at +300 V.

At a point Q7 where a trailing edge of the negative polarity toner B passes the first station a, the positive polarity voltage of the secondary transfer high voltage power supply 21 is turned off, and the negative polarity voltage thereof is turned on. The applied voltage is −1,000 V, and a current of −50 μA flows in the secondary transfer roller 20. The conductive brush high voltage power supply 60 and the conductive roller high voltage power supply 70 are maintained as is at +1,000 V, and therefore +10 μA currents flow in both of the toner charging members (the conductive brush 16 and the conductive roller 17). The resultant current flowing from the secondary transfer roller 20 and the toner charging members (the conductive brush 16 and the conductive roller 17) therefore becomes −30 μA, and the rear surface potential of the intermediate transfer belt 10 is maintained at −300 V in the primary transfer nip portion T1. This is because the resultant current has a negative polarity by satisfying the following relationship, even if the polarity of the voltage applied to the toner charging members (the conductive brush 16 and the conductive roller 17) is positive. The relationship is that the combined value of the current flowing from the secondary transfer roller 20 and the current flowing from the toner charging members is negative.

Figure 17:
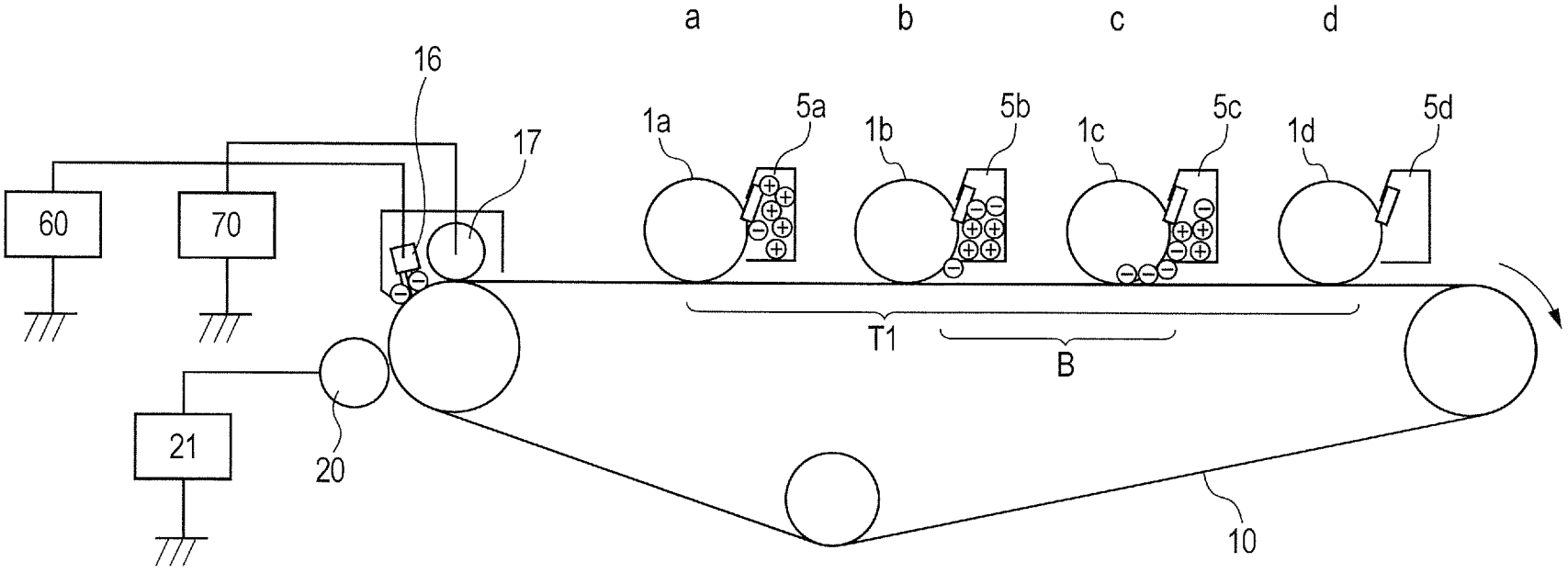
FIG. 17 is a diagram illustrating a toner state in Embodiment 3 of the present invention.

From a timing Q7, a force acts to electrostatically pull the negative polarity toner B away from the intermediate transfer belt 10, and the negative polarity toner B is drawn toward the photosensitive drums 1*a*, 1*b*, 1*c*, and 1*d*. FIG. 17 illustrates a state where the negative polarity toner B is distributed to the cleaning devices 5*b* and 5*c* of the second and third image forming stations b and c. A positive polarity voltage is applied to the conductive brush 16, and therefore the conductive brush 16 continues to primarily collect the negative polarity toner on the intermediate transfer belt 10.

Next, at a timing S8 where all of the negative polarity toner is collected in the cleaning devices 5*b* and 5*c* of the second and third image forming stations b and c, the main motor of the image forming apparatus is turned off. Further, the negative polarity voltage of the secondary transfer high voltage power supply 21 and the positive polarity voltages of the conductive brush high voltage power supply 60 and the conductive roller high voltage power supply 70 are in an on state at the timing Q8, but are turned off 200 ms later (at the timing Q9), thus completing a series of image forming operations.

In Embodiment 3, at the timing Q8 where the main motor is turned off, the positive polarity voltages of the conductive brush high voltage power supply 60 and the conductive roller high voltage power supply 70 are in the on state. This is performed in order to suppress transfer (toner drop) of the negative polarity toner primarily collected by the conductive brush 16 onto the intermediate transfer belt 10 during inertia rotation after the main motor is turned off. Further, the negative polarity voltage of the secondary transfer high voltage power supply 21 is turned on. This is performed in order to maintain the rear surface potential of the intermediate transfer belt 10 at −300 V, and suppress discharge on the positive polarity side to the photosensitive drums 1*a*, 1*b*, 1*c*, and 1*d* in the primary transfer nip portion T1, even when positive polarity voltages of the conductive brush high voltage power supply 60 and the conductive roller high voltage power supply 70 are in an on state.

As described above, according to Embodiment 3, a positive polarity voltage is applied to the charging devices (the conductive brush 16 and the conductive roller 17), which is opposite to the polarity of the toner, at the beginning or the end of image forming operations (rotation driving operations). The following relationship is satisfied in this case, and therefore the rear surface potential of the intermediate transfer belt 10 in the first transfer portion can stably maintain a negative polarity voltage. The relationship is that the combined value of the current flowing from the secondary transfer member and the current flowing from the charging devices is negative.

Discharge from the primary transfer portion, and accompanying drum memory and drum shaving can thus be suppressed while also controlling unnecessary toner drop from the charging devices (the conductive brush 16 and the conductive roller 17).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-260753, filed Nov. 29, 2012, and Japanese Patent Application No. 2012-261366, filed Nov. 29, 2012, which are hereby incorporated by reference herein in their entirety.

What is claimed is:

1. An image forming apparatus, comprising:

an image bearing member for bearing a toner image;

an intermediate transfer member that is endless and moveable, including a primary transfer portion formed by contacting the image bearing member, and a secondary transfer portion, wherein the toner image is primarily transferred from the image bearing member onto the intermediate transfer member in the primary transfer portion and secondarily transferred from the intermediate transfer member onto a transfer material in the secondary transfer portion;

a secondary transfer member to which a voltage is applied, the secondary transfer member contacting an outer peripheral surface of the intermediate transfer member to form the secondary transfer portion;

a charging device to which a voltage is applied, the charging device contacting the outer peripheral surface of the intermediate transfer member to charge toner remaining on the intermediate transfer member;

a first power supply capable of applying one of a positive polarity voltage and a negative polarity voltage to the secondary transfer member;

a second power supply capable of applying one of a positive polarity voltage and a negative polarity voltage to the charging device; and a controller for controlling the first power supply and the second power supply, wherein the charging device is provided on a downstream side of the secondary transfer member and an upstream side of the primary transfer portion with respect to a moving direction of the intermediate transfer member, wherein the intermediate transfer member is configured to determine a polarity of an electric potential formed in the primary transfer portion by a polarity of the current supplied from the secondary transfer member independently of a polarity of a current supplied from the charging device provided at a portion closer to the primary transfer portion, and wherein before the intermediate transfer member starts rotating, the controller applies the positive polarity voltage to the charging device from the second power supply while applying a negative polarity voltage to the secondary transfer member from the first power supply.

2. An image forming apparatus according to claim 1, wherein the toner image is primarily transferred from the image bearing member onto the intermediate transfer member by flowing a current from at least one of the secondary transfer member and the charging device into the image bearing member through the intermediate transfer member; and the toner image is secondarily transferred from the intermediate transfer member onto a recording material by flowing a current from the secondary transfer member into the intermediate transfer member.

3. An image forming apparatus according to claim 1, wherein the charging device contacts the intermediate transfer member on a downstream side of the secondary transfer portion and on an upstream side of the primary transfer portion with respect to the moving direction of the intermediate transfer member.

4. An image forming apparatus according to claim 1, wherein the controller is capable of performing a discharge mode of discharging toner from the charging device to the intermediate transfer member by alternately applying any one of the positive polarity voltage and negative polarity voltage to the charging device.

5. An image forming apparatus according to claim 1, wherein the controller controls the first power supply to apply the negative polarity voltage to the secondary transfer member while causing the second power supply to apply the positive polarity voltage to the charging device before the intermediate transfer member begins to move, to thereby cause the electric potential in the primary transfer portion to have a negative polarity.

6. An image forming apparatus according to claim 1, wherein the controller controls the second power supply to apply the positive polarity voltage to the charging device during a period from after image forming is complete and until movement of the intermediate transfer member is complete.

7. An image forming apparatus according to claim 4, wherein the intermediate transfer member includes an endless intermediate transfer belt; and the image forming apparatus further includes a stretching member to stretch an inner peripheral surface of the intermediate transfer belt.

8. An image forming apparatus according to claim 6, wherein the controller causes the first power supply to apply the negative polarity voltage to the secondary transfer member while causing the second power supply to apply the positive polarity voltage to the charging device during the period from after the image forming is complete and until the movement of the intermediate transfer member is complete, to thereby cause the electric potential in the primary transfer portion to have a negative polarity.

9. An image forming apparatus according to claim 7, wherein the secondary transfer member and the charging device are opposed to the stretching member across the intermediate transfer belt; and the image forming apparatus further comprises a voltage maintaining element connected to the stretching member, for maintaining the stretching member at a predefined potential or more.

10. An image forming apparatus according to claim 7, wherein the secondary transfer member and the charging device are opposed to the stretching member across the intermediate transfer belt; and the image forming apparatus further comprises a constant voltage element connected to the stretching member, for maintaining the stretching member at a predefined potential or more.

11. An image forming apparatus according to claim 10, wherein the constant voltage element includes a Zener diode.

12. An image forming apparatus according to claim 10, wherein the constant voltage element includes a varistor.

* * * * *